US012180806B2

(12) United States Patent
Geiger et al.

(10) Patent No.: US 12,180,806 B2
(45) Date of Patent: Dec. 31, 2024

(54) SUBSURFACE SAFETY VALVE ACTUATOR

(71) Applicant: Moog Inc., East Aurora, NY (US)

(72) Inventors: David Geiger, Hamburg, NY (US); Daniel J. Halloran, East Amherst, NY (US); Jeff Blasz, Eden, NY (US); In Chul Jang, Sugar Land, TX (US); Joseph Giangreco-Marotta, Williamsville, NY (US)

(73) Assignee: Moog Inc., East Aurora, NY (US)

( * ) Notice: Subject to any disclaimer, the term of this patent is extended or adjusted under 35 U.S.C. 154(b) by 0 days.

(21) Appl. No.: 18/036,643

(22) PCT Filed: Nov. 11, 2021

(86) PCT No.: PCT/US2021/058977
§ 371 (c)(1),
(2) Date: May 11, 2023

(87) PCT Pub. No.: WO2022/103959
PCT Pub. Date: May 19, 2022

(65) Prior Publication Data

US 2024/0018846 A1 Jan. 18, 2024

Related U.S. Application Data

(60) Provisional application No. 63/134,699, filed on Jan. 7, 2021, provisional application No. 63/113,012, filed on Nov. 12, 2020.

(51) Int. Cl.
*E21B 34/06* (2006.01)

(52) U.S. Cl.
CPC ..... *E21B 34/066* (2013.01); *E21B 2200/05* (2020.05)

(58) Field of Classification Search
CPC ..... E21B 34/066; E21B 2200/05
See application file for complete search history.

(56) References Cited

U.S. PATENT DOCUMENTS 3,777,814 A 12/1973 Gustavson et al.
3,814,181 A 6/1974 Young
(Continued)

FOREIGN PATENT DOCUMENTS

AU 199956019 A1 5/2000
AU 758196 B2 3/2003
(Continued)

OTHER PUBLICATIONS

Hedge (2015) "Subsea safety valves—types, safe-states, and function," available online at https://systemssafety.wordpress.com/2015/08/14/subsea-safety-valves-types-safe-states-and-function/, 6 pages.
(Continued)

*Primary Examiner* — Taras P Bemko
(74) *Attorney, Agent, or Firm* — Harter Secrest & Emery LLP

(57) ABSTRACT

A subsurface safety valve actuation system in well tubing comprising a safety valve, piston assembly, motor, pump, spring, reservoir, first valve, and second valve configured to provide pressure in a chamber of the piston assembly that drives the safety valve to an open position, retain pressure in the chamber that retains the safety valve in the open position, release pressure in the chamber via a first hydraulic release path and/or a second hydraulic release path between the chamber and the reservoir that extends through the first valve and second valve, respectively, and the first and second hydraulic release paths being independent from each other, whereby pressure in the chamber that retains the safety valve in the open position may be released via the first
(Continued)

or second hydraulic release path when there is a fault in the other of the first or second release path.

30 Claims, 23 Drawing Sheets

(56) References Cited

U.S. PATENT DOCUMENTS

| | | | |
|---|---|---|---|
| 4,344,491 | A | 8/1982 | Nolan et al. |
| 4,395,200 | A | 7/1983 | Anthony et al. |
| 4,440,450 | A | 4/1984 | Coakley |
| 4,600,368 | A | 7/1986 | Sommer |
| 4,629,402 | A | 12/1986 | Marshala |
| 4,667,736 | A | 5/1987 | Rumbaugh et al. |
| 4,681,167 | A | 7/1987 | Soderberg |
| 4,798,247 | A | 1/1989 | Deaton et al. |
| 4,861,239 | A | 8/1989 | Simmons et al. |
| 4,886,114 | A | 12/1989 | Perkins et al. |
| 4,981,173 | A | 1/1991 | Perkins et al. |
| 5,165,274 | A | 11/1992 | Thiercelin |
| 5,184,507 | A | 2/1993 | Drake |
| 5,611,672 | A | 3/1997 | Modesitt |
| 5,893,708 | A | 4/1999 | Nelson |
| 5,992,452 | A | 11/1999 | Nelson |
| 6,109,351 | A | 8/2000 | Beall |
| 6,269,874 | B1 | 8/2001 | Rawson et al. |
| 6,352,107 | B1 | 3/2002 | Bennett et al. |
| 6,543,544 | B2 | 4/2003 | Schultz et al. |
| 6,550,534 | B2 | 4/2003 | Brett |
| 6,619,388 | B2 | 9/2003 | Dietz et al. |
| 6,659,200 | B1 | 12/2003 | Eppink |
| 6,702,025 | B2 | 3/2004 | Meaders |
| 6,851,481 | B2 | 2/2005 | Vinegar et al. |
| 7,201,231 | B2 | 4/2007 | Chaplin et al. |
| 8,453,723 | B2 | 6/2013 | Smithson |
| 8,931,567 | B2 | 1/2015 | Edwards |
| 9,222,312 | B2 | 12/2015 | Anderson |
| 9,534,459 | B2 | 1/2017 | Harms et al. |
| 9,556,707 | B2 | 1/2017 | Vick, Jr. et al. |
| 9,631,455 | B2 | 4/2017 | Geiger et al. |
| 10,428,841 | B2 | 10/2019 | Knoell et al. |
| 10,480,283 | B2 | 11/2019 | Joseph et al. |
| 10,590,752 | B2 | 3/2020 | Al-Gouhi et al. |
| 10,619,450 | B2 | 4/2020 | Richards et al. |
| 2006/0168955 | A1 | 8/2006 | Longfield et al. |
| 2009/0038804 | A1 | 2/2009 | Going |
| 2010/0025045 | A1 | 2/2010 | Lake et al. |
| 2010/0089570 | A1 | 4/2010 | Buyers et al. |
| 2011/0005770 | A1 | 1/2011 | Scranton et al. |
| 2011/0232474 | A1* | 9/2011 | Geiger ..... E21B 33/06 91/159 |
| 2012/0292030 | A1 | 11/2012 | Xu et al. |
| 2013/0333894 | A1 | 12/2013 | Geiger et al. |
| 2014/0008078 | A1 | 1/2014 | Wade et al. |
| 2016/0040526 | A1 | 2/2016 | Mebane, III et al. |
| 2016/0102534 | A1 | 4/2016 | Marshall et al. |
| 2017/0183938 | A1 | 6/2017 | Inglis |
| 2018/0135620 | A1 | 5/2018 | Gubbins et al. |
| 2018/0156015 | A1 | 6/2018 | Ding et al. |
| 2018/0195373 | A1 | 7/2018 | Bell et al. |
| 2018/0202475 | A1 | 7/2018 | Dev et al. |
| 2018/0274319 | A1 | 9/2018 | Lycke et al. |
| 2018/0313196 | A1 | 11/2018 | Frantz, III et al. |
| 2018/0363432 | A1 | 12/2018 | Purcell et al. |
| 2019/0390538 | A1 | 12/2019 | Frantz, III et al. |
| 2020/0392812 | A1 | 12/2020 | Vick, Jr. et al. |
| 2021/0102449 | A1 | 4/2021 | Leonov |
| 2021/0215020 | A1* | 7/2021 | Deville ..... E21B 23/04 |

FOREIGN PATENT DOCUMENTS

| | | | |
|---|---|---|---|
| AU | 777219 | B2 | 10/2004 |
| AU | 2015263830 | B2 | 11/2019 |
| CA | 1137815 | A | 12/1982 |
| CA | 2437395 | A1 | 2/2004 |
| CA | 2535137 | A1 | 8/2006 |
| CA | 2780885 | A1 | 1/2011 |
| CA | 2450707 | C | 5/2011 |
| CA | 2782103 | A1 | 1/2013 |
| CA | 2785500 | A1 | 2/2013 |
| CA | 2922149 | A1 | 9/2016 |
| CA | 2915601 | A1 | 6/2017 |
| CN | 1222647 | A | 7/1999 |
| CN | 101403293 | A | 4/2009 |
| CN | 101440784 | A | 5/2009 |
| CN | 101363437 | B | 6/2010 |
| CN | 107060738 | A | 8/2017 |
| CN | 108167260 | A | 6/2018 |
| EP | 0490420 | B1 | 4/1995 |
| EP | 1062405 | B1 | 6/2003 |
| EP | 1930540 | A1 | 6/2008 |
| EP | 2815063 | A1 | 12/2014 |
| EP | 2529078 | B1 | 9/2017 |
| FR | 2881466 | A1 | 8/2006 |
| GB | 2330598 | A | 4/1999 |
| GB | 2337065 | B | 10/2002 |
| GB | 2376483 | A | 12/2002 |
| GB | 2385075 | B | 8/2006 |
| GB | 2438043 | A | 11/2007 |
| GB | 2454908 | A | 5/2009 |
| GB | 2457143 | A | 8/2009 |
| GB | 2492682 | A | 1/2013 |
| GB | 2487141 | B | 10/2014 |
| GB | 2500094 | B | 10/2014 |
| GB | 2488687 | B | 6/2015 |
| GB | 2569108 | A | 6/2019 |
| IN | 201717008235 | A | 7/2017 |
| NO | 20161785 | A1 | 11/2016 |
| RU | 2447461 | C2 | 4/2012 |
| RU | 2471065 | C2 | 12/2012 |
| RU | 2011127952 | A | 1/2013 |
| RU | 2487230 | C2 | 7/2013 |
| RU | 2529310 | C1 | 9/2014 |
| RU | 2596175 | C1 | 8/2016 |
| RU | 2610948 | C1 | 2/2017 |
| RU | 2613150 | C1 | 3/2017 |
| RU | 2628679 | C1 | 8/2017 |
| WO | 1987006653 | A1 | 11/1987 |
| WO | 1996032599 | A2 | 10/1996 |
| WO | 2001065061 | A1 | 9/2001 |
| WO | 0236968 | A1 | 5/2002 |
| WO | 2003048572 | A1 | 6/2003 |
| WO | 2008125824 | A1 | 10/2008 |
| WO | 2010030423 | A1 | 3/2010 |
| WO | 2011000102 | A1 | 1/2011 |
| WO | 2011062824 | A2 | 5/2011 |
| WO | 2013082386 | A1 | 6/2013 |
| WO | 2014124525 | A1 | 8/2014 |
| WO | 2014207027 | A1 | 12/2014 |
| WO | 2015047875 | A1 | 4/2015 |
| WO | 2015176107 | A1 | 11/2015 |
| WO | 2016172246 | A1 | 10/2016 |
| WO | 2017007656 | A1 | 1/2017 |
| WO | 2017023303 | A1 | 2/2017 |
| WO | 2017097945 | A1 | 6/2017 |
| WO | 2018096345 | A1 | 5/2018 |
| WO | 2019013676 | A1 | 1/2019 |
| WO | 2019089487 | A1 | 5/2019 |
| WO | 2019135775 | A1 | 7/2019 |
| WO | 2019143310 | A1 | 7/2019 |
| WO | 2020060556 | A1 | 3/2020 |
| WO | 2020071915 | A1 | 4/2020 |

OTHER PUBLICATIONS

Molnes (1993) "Reliability of Surface Controlled Subsurface Safety Valves and Well Completions," Presented at EEU-Course "Safety and Reliability of Subsea Production Systems," NTH, Trondheim, 17 pages.

* cited by examiner

SOLENOID DIAGNOSTICS FUNCTION (OPTION 3)

SUBSURFACE SAFETY VALVE ACTUATOR

TECHNICAL FIELD

The present invention relates generally to the field of subsea drilling, processing and production equipment, and more particularly to an improved subsurface safety valve actuator system.

BACKGROUND ART

In subsea oil and gas exploration, the drilling system or wellhead may be located many thousands of feet below the sea surface and the well may in turn extend many thousands of feet below the sea floor. Specialized equipment is therefore used to drill, produce and process oil and gas on the sea floor, such as subsea trees, processing systems, separators, high integrity pipeline protection systems, drills, manifolds, tie-in systems and production and distribution systems. Such equipment is commonly controlled by a number of types of valves, including blow-out preventers to stop the unintended discharge of hydrocarbons into the sea.

Subsurface safety valves (SSSVs) are typically installed in the wellbore of hydrocarbon producing wells to shut off the flow of production fluids to the surface of the well in case of an emergency. It is known that such SSSVs may be flapper valves that open downwards such that the flow of fluid in the well will act to push the valve shut while pressure from the surface will act to push the valve open.

Existing SSSVs are operated hydraulically from the surface by providing pressurized hydraulic fluid from a surface vessel down to the wellhead. Large hydraulic power lines from vessels or rigs on the ocean surface feed the ocean floor drilling, production and processing equipment. When hydraulic pressure is applied down a hydraulic pressure line from the ocean surface, the hydraulic pressure forces a sleeve within the SSSV to slide downwards and compress a large spring and push the valve flapper downwards and out of the fluid channel to open the SSSV. When hydraulic pressure is removed, the spring pushes the sleeve back up and thereby causes the flapper to shut and close off the fluid channel. In this way, the SSSV is a failsafe valve that will isolate the wellbore in the event of an emergency.

BRIEF SUMMARY OF THE INVENTION

With parenthetical reference to corresponding parts, portions or surfaces of the disclosed embodiment, merely for the purposes of illustration and not by way of limitation, the present disclosure provides a subsurface safety valve actuation system (90) comprising tubing (16, 80) arranged in a well (105) and forming a flow channel (18) to a surface level (104) for fluids originating from below the surface level; a safety valve (91) in the tubing (80) below the surface level (104*a*) and operable between an open position (FIG. 2) and a closed position (FIG. 3) to control a flow of fluids in the flow channel (18); a hydraulic piston assembly (92, 192, 492) in the tubing (80) below the surface level (104*a*) comprising a first chamber (2) and a piston (4, 404) between the first chamber (2) and the safety valve (91); an electric motor (10) in the tubing (80) below the surface level (104*a*) and configured to be supplied with a current; a hydraulic pump (8) in the tubing (80) below the surface level (104*a*) and configured to be driven by the motor (10) and connected to the first chamber (2) of the hydraulic piston assembly (92, 192, 492); a spring element (36) in the tubing (80) below the surface level (104*a*) and configured to provide a spring force upon the piston (4, 404); a fluid reservoir (14) connected to the pump (8) and the first chamber (2); a first valve (34, 234) connected to the first chamber (2) and the fluid reservoir (14) and having a first open position (FIGS. 8, 12, 14) and a first closed position (FIGS. 6, 7, 11, 13, 17, 18); a second valve (35) connected to the first chamber (2) and the fluid reservoir (14) and having a second open position (FIGS. 8, 14) and a second closed position (FIGS. 6, 7, 11, 12, 13, 17, 18); the pump (8), hydraulic piston assembly (92, 192, 492), first valve (34, 234), second valve (35) and reservoir (14) connected in a substantially closed hydraulic system (93, 193, 293, 393); wherein the hydraulic system (93, 193, 293, 393) is configured in a first state (FIGS. 6, 12) to provide pressure in the first chamber (2) that drives the safety valve (91) from the closed position to the open position; wherein the hydraulic system (93, 193, 293, 393) is configured in a second state (FIGS. 7, 11, 13, 17, 18) to retain a pressure level in the first chamber (2) that retains the safety valve (91) in the open position; wherein the hydraulic system (93, 193, 293, 393) is configured in a third state (FIGS. 10, 16) to release the pressure level in the first chamber (2) via a first hydraulic release path (6, 206/20/34/7, 107; 206/234/22/8/7, 107) between the first chamber (2) and the reservoir (14) that extends through the first valve (34, 234) when the first valve (34, 234) is in the first open position; wherein the hydraulic system (93, 193, 293, 393) is configured in a fourth state (FIGS. 9, 15) to release the pressure level in the first chamber (2) via a second hydraulic release path (6, 206/21/35/7, 107) between the first chamber (2) and the reservoir (14) that extends through the second valve (35) when the second valve (35) is in the second open position; and wherein the first hydraulic release path (6, 206/20/34/7, 107; 206/234/22/8/7, 107) is independent from the second hydraulic release path (6, 206/21/35/7, 107) and the second hydraulic release path (6, 206/21/35/7, 107) is independent from the first hydraulic release path (6, 206/20/34/7, 107; 206/234/22/8/7, 107); whereby the pressure level in the first chamber (2) that retains the safety valve (91) in the open position may be released via the first hydraulic release path (6, 206/20/34/7, 107; 206/234/22/8/7, 107) when there is a fault in the second hydraulic release path (6, 206/21/35/7, 107) and may be released via the second hydraulic release path (6, 206/21/35/7, 107) when there is a fault in the first hydraulic release path (6, 206/20/34/7, 107; 206/234/22/8/7, 107).

The hydraulic system (93, 193, 293, 393) may configured in the second state (FIGS. 7, 11, 13, 17, 18) to retain the pressure level in the first chamber (2) independent of the motor (10) and the pump (8). The second state (FIGS. 7, 11, 13, 17, 18) may comprise the first valve (34, 234) in the first closed position and the second valve (35) in the second closed position.

The spring element (36) may be in compression between the piston (4, 404) and the tubing (66) in the second state (FIGS. 7, 11, 13, 17, 18). The hydraulic piston assembly (192) may consist essentially of the first chamber (2) connected in the closed hydraulic system.

The first hydraulic release path (206/234/22/8/7, 107) may extend through the pump (8). The first state (FIG. 12) may comprise providing a hydraulic force on the piston (4, 404) that is opposite to and exceeds the spring force and the piston (4, 404) translating in a first direction and actuating the safety valve (91) to the open position. The first state (FIG. 12) may comprise the first valve (234) in the first open position and driving the motor (10) to control a flow of fluid to the first chamber (2) through the pump (8). The second hydraulic release path (206/21/35/7, 107) may be independent of the pump (8). The first state (FIG. 12) may comprise the first valve (234) in the first open position and the second valve (35) in the second closed position.

The hydraulic piston assembly (92, 492) may comprises a second chamber (3) connected to the fluid reservoir (14); the piston (4, 404) may separate the first and second chambers; and a positive pressure differential between the first chamber (2) and the second chamber (3) may provide the hydraulic force on the piston (4, 404) that is opposite to and exceeds the spring force. A negative pressure differential between the first chamber (2) and the second chamber (3) may provide a hydraulic force on the piston in a second direction opposite to the first direction. The third state may comprise the negative pressure differential and the resulting hydraulic force and the spring force causing the piston (4, 404) to translate in a second direction actuating the safety valve (91) to the closed position.

The second state (FIGS. 13, 17, 18) may comprise providing a hydraulic force on the piston (4, 404) that is opposite and at least equal to the spring force. The second state (FIGS. 13, 17, 18) may comprise the first valve (234) in the first closed position. The second hydraulic release path (6, 206/21/35/7, 107) may be independent of the pump (8). The second state (FIGS. 13, 17, 18) may comprise the second valve (35) in the second closed position.

The third state (FIG. 16) may comprise providing a hydraulic force on the piston (4, 404) opposite to the spring force that is less than the spring force and the piston translating in a second direction opposite to the first direction and actuating the safety valve (91) to the closed position. The second hydraulic release path (6, 206/21/35/7, 107) may be independent of the pump (8). The third state (FIG. 16) may comprise the second valve (35) in a faulted closed state. The third state may comprise driving the motor (10) to control a rate of fluid flow in the first hydraulic release path (206/234/22/8/7, 107). The third state may comprise releasing the motor (10) and the pump (8) to allow fluid flow in the first hydraulic release path (206/234/22/8/7, 107). The third state may comprise the second valve (35) in the second closed position and releasing the motor (10) and the pump (8) to allow fluid flow in the first hydraulic release path (206/234/22/8/7, 107). The third state may comprise the second valve (35) in the second closed position and driving the motor (10) to control a rate of fluid flow in the first hydraulic release path (206/234/22/8/7, 107).

The fourth state (FIG. 15) may comprise providing a hydraulic force on the piston (4, 404) opposite to the spring force that is less than the spring force and the piston (4, 404) translating in a second direction opposite to the first direction and actuating the safety valve (91) to the closed position. The fourth state (FIG. 15) may comprise the first valve (234) in a faulted closed position and/or the pump in a faulted blocked flow position.

The first hydraulic release path (6, 206/20/34/7, 107) may be independent of the pump (8) and the second hydraulic release path (6, 206/21/35/7, 107) may be independent of the pump (8). The first state (FIG. 6) may comprise providing a hydraulic force on the piston (4, 404) that is opposite to and exceeds the spring force and the piston (4, 404) translating in a first direction and actuating the safety valve (91) to the open position. The first state (FIG. 6) may comprise the first valve (34) in the first closed position, the second valve (35) in the second closed position, and driving the motor (10) to control a flow of fluid to the first chamber (2) through the pump (8).

The hydraulic piston assembly (92, 492) may comprises a second chamber (3) connected to the fluid reservoir (14); the piston (4, 404) may separate the first and second chambers; and a positive pressure differential between the first chamber (2) and the second chamber (3) may provide the hydraulic force on the piston (4, 404) that is opposite to and exceeds the spring force. A negative pressure differential between the first chamber (2) and the second chamber (3) may provide a hydraulic force on the piston in a second direction opposite to the first direction. The third state may comprise the negative pressure differential and the resulting hydraulic force and the spring force causing the piston (4, 404) to translate in a second direction actuating the safety valve (91) to the closed position.

The second state (FIG. 7) may comprise providing a hydraulic force on the piston (4, 404) that is opposite and at least equal to the spring force. The second state (FIG. 7) may comprise the first valve (34) in the first closed position and the second valve (35) in the second closed position. The actuation system may comprise a check valve (24) between the pump (8) and the first chamber (2) operatively arranged to permit fluid flow from the pump (8) to the first chamber (2) and to block fluid flow from the first chamber (2) to the pump (8), thereby retaining the pressure level in the first chamber (2) independent of the motor (10) and the pump (8).

The third state (FIG. 10) may comprise providing a hydraulic force on the piston (4, 404) opposite to the spring force that is less than the spring force and the piston (4, 404) translating in a second direction opposite to the first direction and actuating the safety valve (91) to the closed position. The third state (FIG. 10) may comprise the second valve (35) in a faulted closed position. The third state may comprise the second valve (35) in the second open position.

The fourth state (FIG. 9) may comprises providing a hydraulic force on the piston (4, 404) opposite to the spring force that is less than the spring force and the piston (4, 404) translating in a second direction opposite to the first direction and actuating the safety valve (91) to the closed position. The fourth state (FIG. 9) may comprise the first valve (34) in a faulted closed position. The fourth state may comprise the first valve (34) in the first open position.

The actuation system may comprise a third hydraulic release path (6/22/8/7, 107) between the first chamber (2) and the reservoir (14) that extends through the pump (8) when the motor (10) and the pump (8) are released to allow fluid flow in the third hydraulic release path (6/22/8/7, 107); and the third hydraulic release path (6/22/8/7, 107) may be independent from both the first hydraulic release path (6/20/34/7, 107) and the second hydraulic release path (6/21/35/7, 107). The actuation system may be configured in a fifth state to release the pressure level in the first chamber (2) via the third hydraulic release path (6/22/8/7, 107) between the first chamber (2) and the reservoir (14) that extends through the pump (8) when the motor (10) and the pump (8) are released to allow fluid flow in the third hydraulic release path (6/22/8/7, 107).

The fluid reservoir (13) may comprise a pressure compensator (15/16) configured to normalize pressure differences between outside the hydraulic system and inside the hydraulic system. The pressure compensator may comprise a membrane or a piston (15). The actuation system may comprise a position sensor (53) configured to sense position of the membrane or the piston (15).

The first valve (34, 234) may comprise an active actuated valve arranged to open and allow equalization of fluid pressure on each side of the first valve and the second valve (35) may comprise an active actuated valve arranged to open and allow equalization of fluid pressure on each side of the second valve. The first valve (34, 234) may comprise a solenoid valve arranged to open in the event of a power failure allowing equalization of fluid pressure on each side of the first valve and the second valve (35) may comprise a solenoid valve arranged to open in the event of a power failure allowing equalization of fluid pressure on each side of the second valve.

The tubing (80) may comprise an outer tubular surface (81) orientated about a longitudinal axis (x-x); an inner tubular surface (82) orientated about the longitudinal axis and defining the flow channel (18); a first module cavity (84) between the inner tubular surface (82) and the outer tubular surface (81); a second module cavity (83) between the inner tubular surface (82) and the outer tubular surface (81); the hydraulic piston assembly (92) may be disposed in the first module cavity (84); and the motor (10) and the pump (8) may be disposed in the second module cavity (83).

The safety valve may comprise: a flapper element (61) configured to rotate about a hinge axis (62) between the open position and the closed position in the flow channel (18); the hinge axis (62) fixed relative to the tubing (80); a flapper actuation sleeve (64) orientated about the longitudinal axis and configured to move the flapper element (61) from the closed position to the open position in the flow channel (18).

The hydraulic piston assembly (92, 192) may comprise a first actuator rod (5, 405*b*) connected to the piston (4, 404) for movement therewith, a first actuator collar (60) connected to the actuator rod (5, 405*b*) for movement therewith, and the flapper actuation sleeve (64) may be connected to the actuator collar (60) for movement therewith. The spring element (36) may be in compression between the piston (5, 405) and the tubing (80, 66) in the second state and may comprise a coil spring (36) orientated about the longitudinal axis and disposed axially between the hinge axis (62) and the first actuator collar (60).

The hydraulic piston assembly (92, 492) may comprise a second chamber (3) connected to the fluid reservoir (14) and the piston (4, 404) may separate the first and second chambers. The piston (4, 404) may comprise a first surface area (4*a*, 404*a*) exposed to the first chamber (2) and a second surface area (4*b*, 404*b*) exposed to the second chamber (3). The first surface area (4*a*, 404*a*) may equal to or greater than the second surface area (4*b*, 404*b*). The hydraulic piston assembly (92, 492) may comprise a cylinder (9, 409) having a first end wall (9*b*, 409*b*) and the piston (4, 404) may disposed in the cylinder (9, 409) for sealed sliding movement there along; and the hydraulic piston assembly (92, 492) may comprise a first actuator rod (5, 405*b*) connected to the piston (4, 404) for movement therewith and having a portion sealingly penetrating the first end wall (9*b*, 409*b*). The cylinder (409) may have a second end wall (409*a*), the hydraulic piston assembly (492) may comprise a second actuator rod (409*a*) connected to the piston (404) for movement therewith and having a portion sealingly penetrating the second end wall (409*a*), and the first surface area (405*a*) may be equal to the second surface area (405*b*).

The actuation system may comprise subsurface control electronics (95) below the surface level and connected to the motor (10), the first valve (34, 234), and the second valve (35); a surface controller (11) above the surface level (103); a power cable (12) supplying electric power from the surface level (103) to the subsurface control electronics (95); and a communication cable (12) between the subsurface control electronics (95) and the surface controller (11).

The actuation system may comprise multiple sensors (40*a*, 40*b*, 53) configured to sense operating parameters of the system and the subsurface control electronics (95) may comprise a signal processor communicating with the sensors (40*a*, 40*b*, 53) and configured to receive sensor data from the sensors (40*a*, 40*b*, 53) and to output data to the surface controller (11) via the communication cable (12). The actuation system may comprise a position sensor configured to sense position of the piston (4) and the position sensor may comprise a first contact switch (40*a*) and a second contact switch (40*b*).

The electric motor (10) may comprise a variable speed electric motor and the hydraulic pump (8) may comprise a reversible hydraulic pump. The hydraulic pump may be selected from a group consisting of a fixed displacement pump, a variable displacement pump, a two-port pump, and a three-port pump.

The actuation system may comprising a subsurface controller (74) below the surface level (104) and connected to the motor (10), the first valve (34) and the second valve (35); a subsurface sensor (40*a*, 40*b*, 53, 153, 43, 44, 41) below the surface level (104) configured to sense an operating parameter of a component (92, 13, 34, 35) of the actuation system (90) and connected to the controller (74); and the subsurface controller (74) may comprise a non-transitory, computer-readable medium storing one or more instructions executable by the subsurface controller (74) to perform a diagnostic test (210, 300, 400, 400*b*, 400*c*) of the component (92, 13, 34, 35) of the actuation system as a function of the operating parameter of the component (92, 13, 34, 35) of the actuation system sensed by the subsurface sensor (40*a*, 40*b*, 53, 153, 43, 44, 41). The fluid reservoir (13) may comprises a pressure compensator (13), the component of the actuation system may be selected from a group consisting of the pressure compensator (13), the hydraulic piston assembly (92), the first valve (34), and the second valve (35); and the subsurface sensor may be selected from a group consisting of a position sensor (40*a*, 40*b*, 53, 153), a current sensor (76), and a pressure sensor (41).

The subsurface sensor comprises a position sensor (40*a*, 40*b*) configured to sense a position of the piston (4, 60) of the hydraulic piston assembly (92) and the diagnostic test (210) may comprise: commanding movement (212, 215) of the piston (4, 60) to a preset position; monitoring (216) the position sensor (40*a*, 40*b*) after the commanded movement (212, 215); and determining (213, 217) an operational state (222, 219, 220) of the hydraulic piston assembly (92) as a function of an output or an absence of an output from the monitored position sensor (40*a*, 40*b*). The step of determining an operational state of the hydraulic piston assembly may be a function of a threshold elapsed time (214, 218) from the commanded movement.

The pressure compensator (13) may comprise a compensator membrane or a compensator piston (15), the subsurface sensor may comprise a position sensor (53, 153) configured to sense position of the compensator membrane or the compensator piston (15), and the diagnostic test (300) may comprise: commanding movement (302, 305) of the piston (4, 60) of the hydraulic piston assembly (92) to a preset position; monitoring (306) the compensator position sensor (53, 153) after the commanded movement (302, 305); and determining (314) an operational state (315, 316) of the pressure compensator (13) as a function of an output or an absence of an output from the monitored compensator position sensor (53, 153). The step of determining an operational state of the pressure compensator may be a function of a threshold elapsed time (308) from the commanded movement.

The first or second valve (34, 35) may comprise a solenoid valve arranged to open in the event of a power failure allowing equalization of fluid pressure on each side of the valve, the subsurface sensor may comprise a current sensor (76) configured to sense current of the solenoid valve, and the diagnostic test (400) may comprise: commanding (405) energizing of the solenoid valve; monitoring (406) the current sensor (76) after the commanded energizing; and determining (408) an operational state (409, 410) of the solenoid valve as a function of an output from the monitored current sensor (76). The step of determining an operational state of the solenoid valve may be a function of current reference data stored in the subsurface controller (74). The first or second valve (34, 35) may comprise a solenoid valve arranged to open in the event of a power failure allowing equalization of fluid pressure on each side of the valve, the subsurface sensor may comprise a valve position sensor (43, 44) configured to sense position of the solenoid valve, and the diagnostic test (400*b*) may comprise: commanding (405*b*) energizing of the solenoid valve; monitoring (406*b*) the valve position sensor (43, 44) after the commanded energizing; and determining (408*b*) an operational state (409*b*, 410*b*) of the solenoid valve as a function of an output or an absence of an output from the monitored valve position sensor (43, 44). The first or second valve may comprises a solenoid valve arranged to open in the event of a power failure allowing equalization of fluid pressure on each side of the first valve, the pump (8) may comprise a rotary pump, the subsurface sensor may comprises a pressure sensor (41) configured to sense pressure in the closed hydraulic system (93), and the diagnostic test (400*c*) may comprise: commanding deenergizing (403, 409*c*, 413*c*) of the solenoid valve; commanding (405*c*) rotation of the rotary pump at a reference speed of rotation; monitoring (404*c*) the pressure sensor (41) after the commanded deenergizing of the solenoid valve; and determining (406*c*, 408*c*, 410*c*, 412*c*, 414*c*, 416*c*) an operational state (419*c*, 420*c*, 421*c*, 418*c*) of the solenoid valve as a function of an output from the monitored pressure sensor (41). The step of determining an operational state of the solenoid valve may be a function of stored pressure reference data. The diagnostic test (400*c*) may comprise: commanding (407*c*, 411*c*, 415*c*) energizing of the solenoid valve; and monitoring (404*c*) the pressure sensor after the commanded energizing of the solenoid valve.

DETAILED DESCRIPTION OF THE EMBODIMENTS

Figure 1:
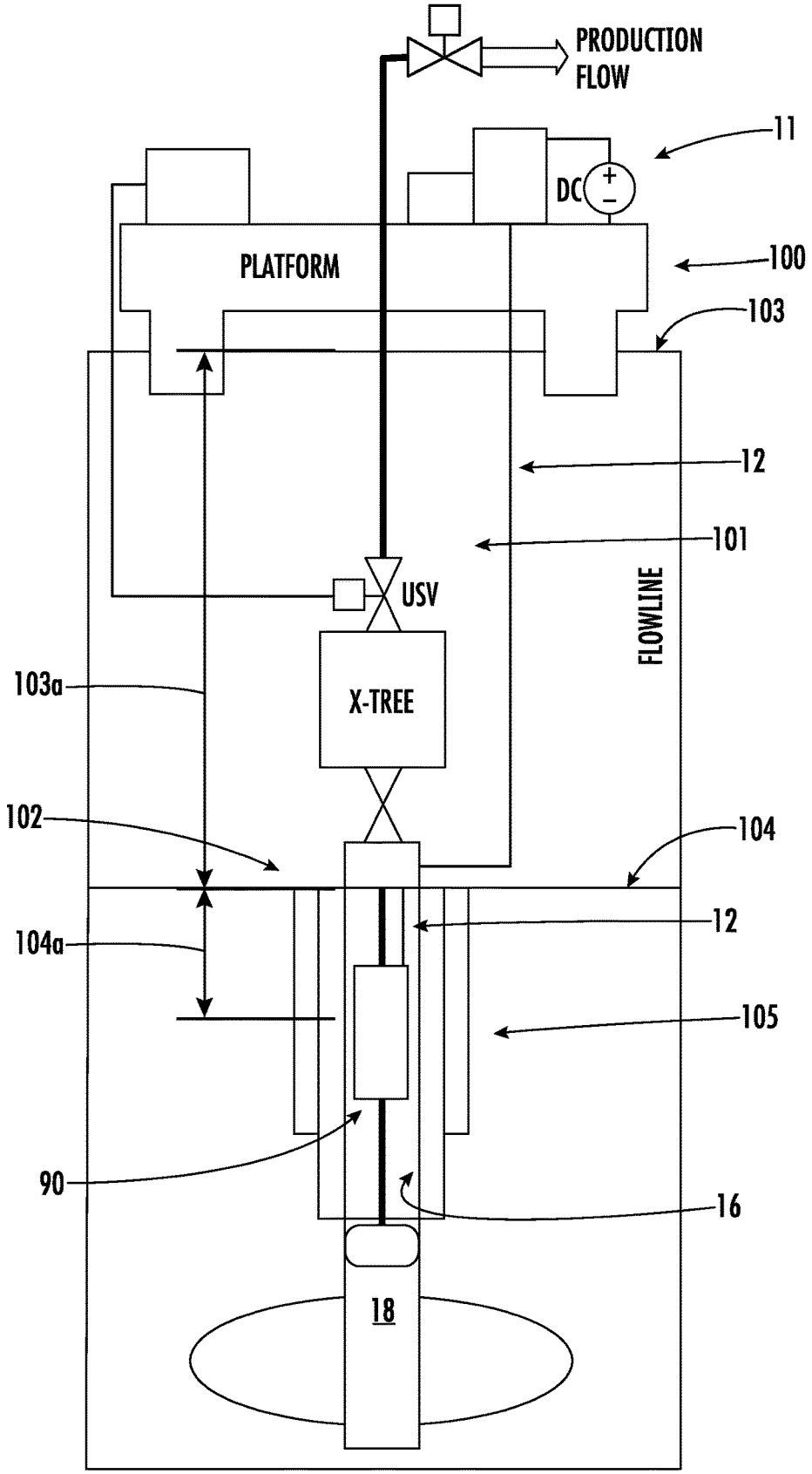
FIG. 1 is a schematic view of a subsea oil well installation having an embodiment of the improved safety valve actuator system in a subsurface production line.

At the outset, it should be clearly understood that like reference numerals are intended to identify the same structural elements, portions or surfaces consistently throughout the several drawing figures, as such elements, portions or surfaces may be further described or explained by the entire written specification, of which this detailed description is an integral part. Unless otherwise indicated, the drawings are intended to be read (e.g., cross-hatching, arrangement of parts, proportion, degree, etc.) together with the specification, and are to be considered a portion of the entire written description of this invention. As used in the following description, the terms "horizontal", "vertical", "left", "right", "up" and "down", as well as adjectival and adverbial derivatives thereof (e.g., "horizontally", "rightwardly", "upwardly", etc.), simply refer to the orientation of the illustrated structure as the particular drawing figure faces the reader. Similarly, the terms "inwardly" and "outwardly" generally refer to the orientation of a surface relative to its axis of elongation, or axis of rotation, as appropriate.

Referring now to the drawings, and more particularly to FIG. 1 thereof, the present disclosure broadly provides a surface controlled subsurface safety valve (SCSSV), of which an embodiment is indicated at 90. Subsurface safety valve 90 is employed in a production system that includes platform 100 floating on the surface 103 of the sea and production line 101 extending from subsea well head 102 a distance 103*a* below surface 103 to platform 100. A drilled well hole 105 extends from floor 104 of the sea to a point below floor 104 of the sea. The well hole is lined with casing and production tubing 16 to form well bore 18 that provides fluid communication between well bore 18 and a surrounding hydrocarbon-bearing formation. Subsurface safety valve 90 is disposed in tubing 16 a distance 104*a* to stop production fluid flow in subsurface tubing 16 if needed, such as in an emergency. Subsurface safety valve 90 operates in a fail-safe mode, with hydraulic control pressure used to hold open flapper valve 91 and such that flapper valve 91 will close if the control pressure is lost, thereby blocking flow from well head 102.

Surface controller 11 on platform 100 communicates with subsurface control electronics 95 via power and data cable 12. In an emergency, surface controller 11 may provide a valve closure command to downhole control electronics 95 and such command may include power cutoff to control electronics 95 and subsurface safety valve 90. Surface controller 11 may also store and relays sensory data from subsurface safety valve 90 and otherwise provide a user interface for reviewing sensory data and setting operational parameters. The processor may include data sampling and storage mechanisms for receiving and storing sensory data and may include data storage for storing operational parameters as well as sensory data logs.

Figure 2:
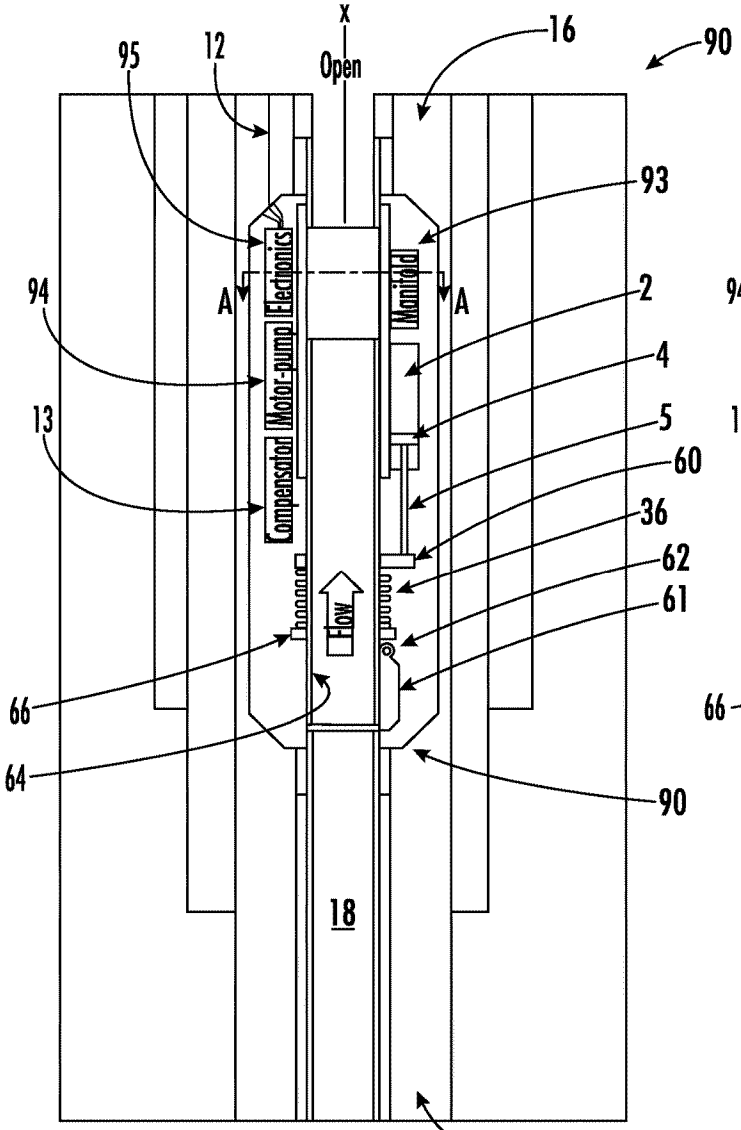
FIG. 2 is an enlarged schematic view of the embodiment of the safety valve actuator system shown in FIG. 1 in an open position.
Figure 5:
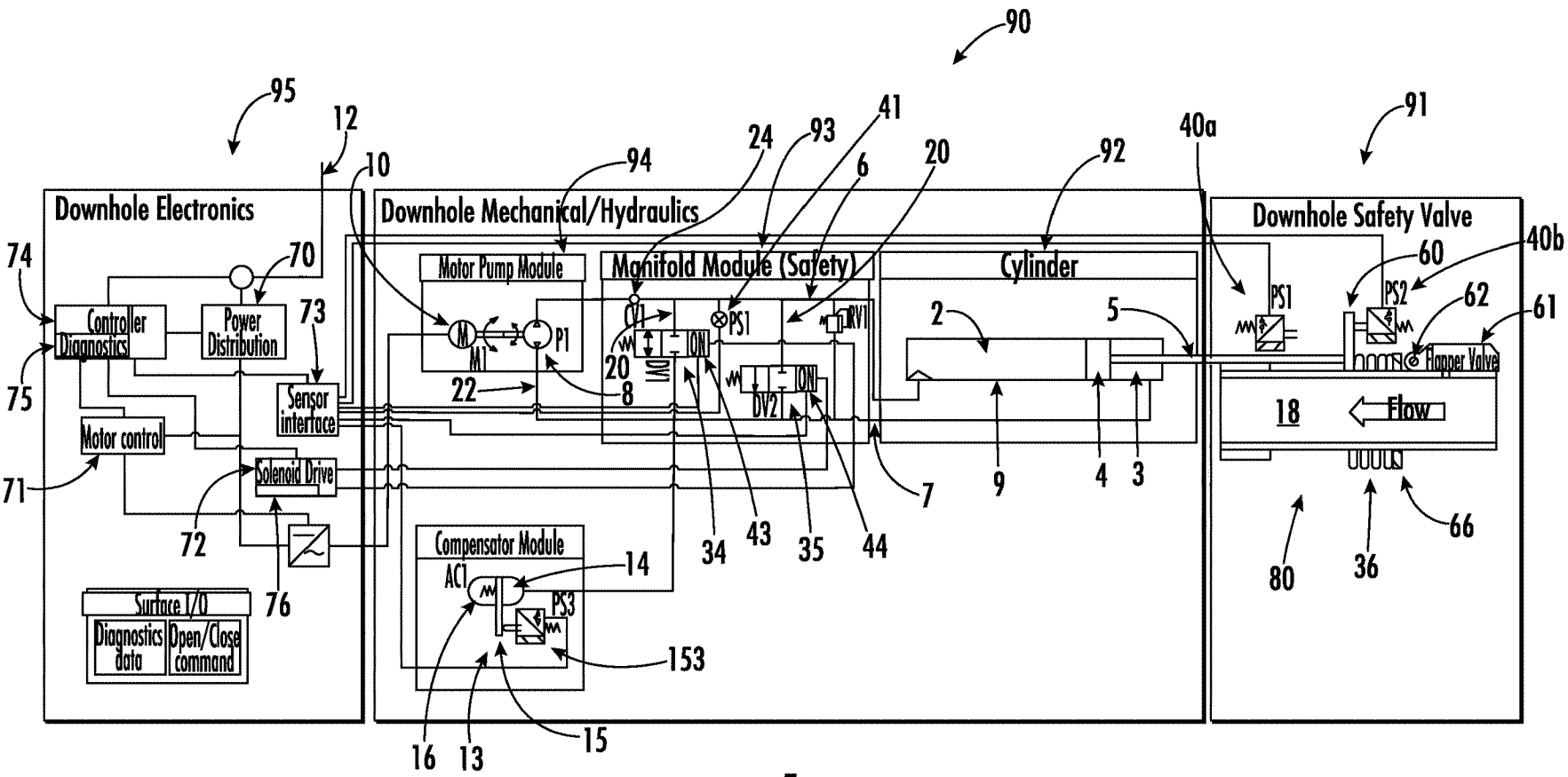
FIG. 5 is a detailed schematic view of the embodiment of the safety valve actuator system shown in FIG. 1.

As shown in FIGS. 2 and 5, subsurface safety valve 90 generally comprises motor and pump assembly or module 94, hydraulic manifold assembly or module 93, system pressure compensated reservoir assembly or module 13, hydraulic piston actuator assembly or module 92, safety valve assembly or module 91, and downhole control electronics 95. Each of these modules are contained in tubing 16.

Figure 3:
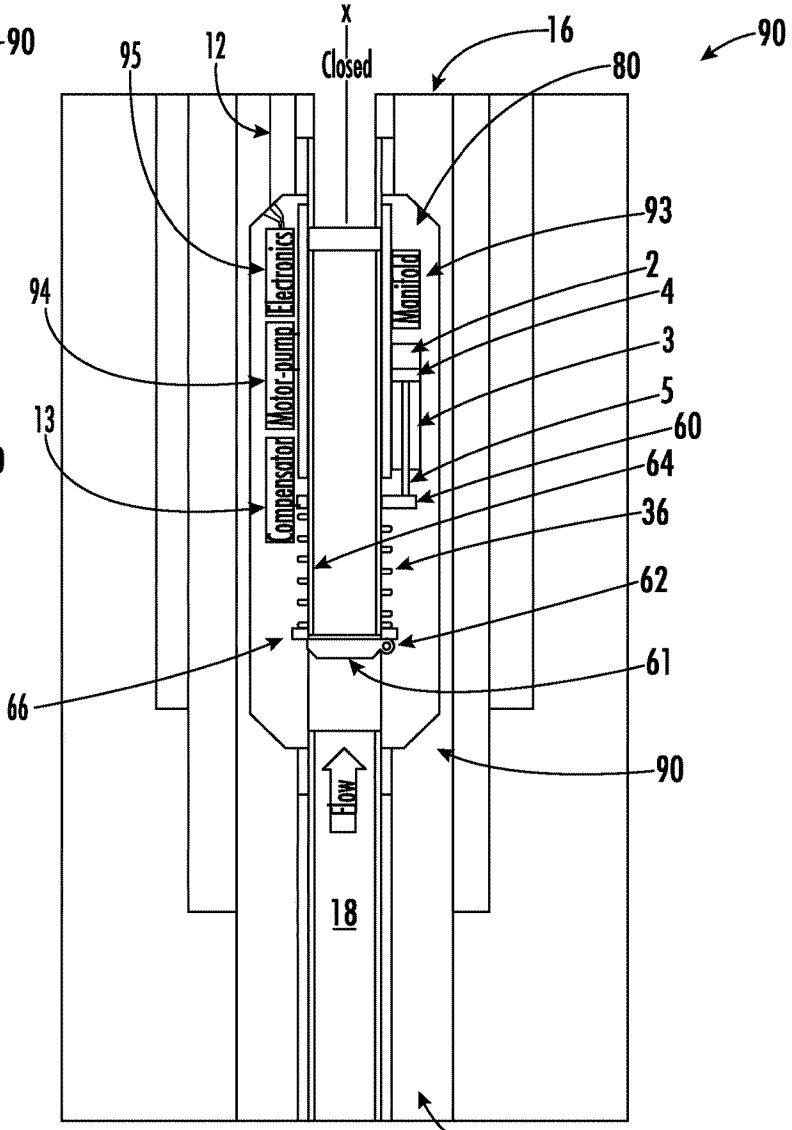
FIG. 3 is an enlarged schematic view of the embodiment of the safety valve actuator system shown in FIG. 1 in a closed position.
Figure 4:
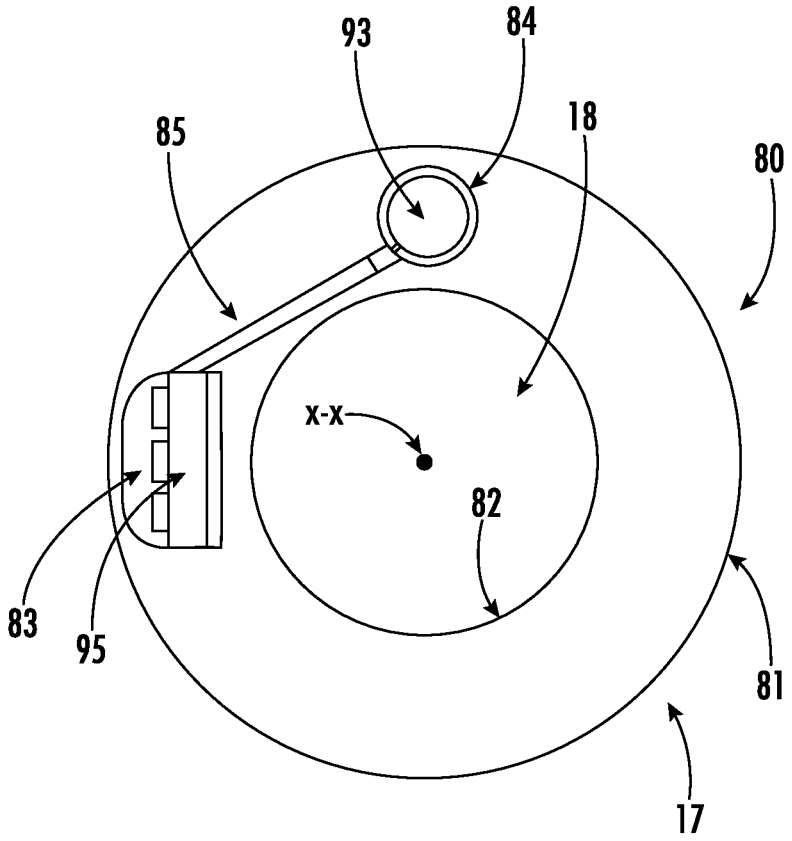
FIG. 4 is a horizontal cross-sectional view of the assembly shown in FIG. 3, taken generally on a line A-A of FIG. 3.

As shown in FIGS. 2-4, in this embodiment, section 80 of tubing 16 houses motor and pump assembly 94, hydraulic manifold assembly 93, system pressure compensated reservoir assembly 13, hydraulic piston actuator assembly 92, and downhole control electronics 95 between outer cylindrical surface 81 and inner cylindrical surface 82 of tubing section 80. In this embodiment, section 80 includes a first circumferentially spaced and longitudinally extending cavity 83 and a second circumferentially spaced and longitudinally extending cavity 84. In this embodiment, compensated reservoir assembly 13, motor and pump assembly 94, and control electronics 95 are stacked in cavity 83, with control electronics on top of and sealed from compensated reservoir assembly 13 and motor and pump assembly 94. Hydraulic manifold assembly 93 and hydraulic piston actuator assembly 92 are stacked in cavity 84. Fluid conduit 85 extends through section 80 between compensated reservoir assembly 13 and motor and pump assembly 94 in cavity 83, and hydraulic manifold assembly 93 and hydraulic piston actuator assembly 92 in cavity 84.

Figure 20:
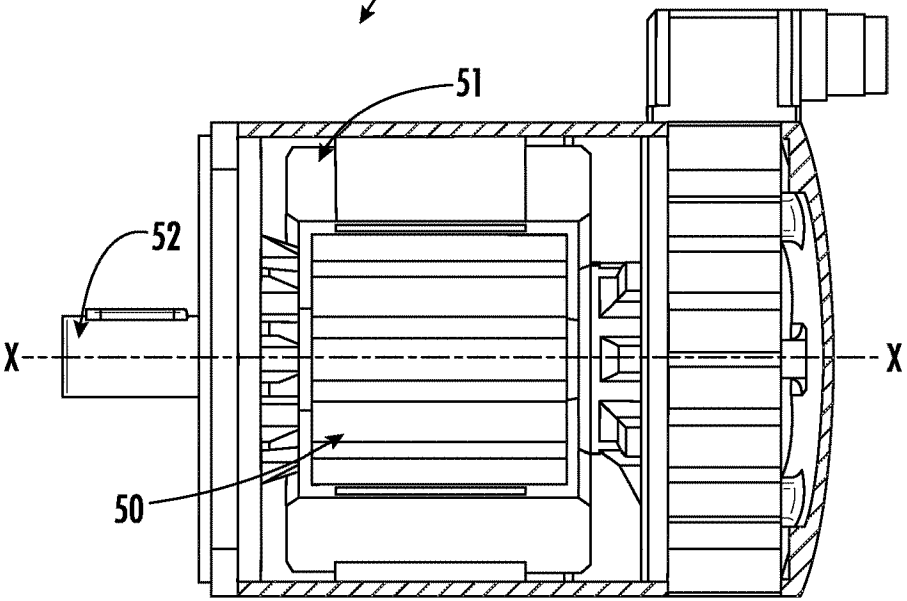
FIG. 20 is a cross-sectional view of the electric variable-speed bi-directional motor shown in FIG. 5.

The pump and motor assembly 94 generally comprises variable speed bidirectional electric servomotor 10 and bi-directional or reversible pump 8 driven by motor 10. As shown in further detail in FIG. 20, in this embodiment motor 10 is a brushless D.C. variable-speed servo-motor that is supplied with a current. Motor 10 has an inner rotor 50 with permanent magnets and a fixed non-rotating stator 51 with coil windings. When current is appropriately applied through the coils of stator 51, a magnetic field is induced. The magnetic field interaction between stator 51 and rotor 50 generates torque which may rotate output shaft 52. Drive electronics 71, based on position feedback, generate and commutate the stator fields to vary the speed and direction of motor 10. Accordingly, motor 10 will selectively apply a torque on shaft 52 in one direction about axis x-x at varying speeds and will apply a torque on shaft 52 in the opposite direction about axis x-x at varying speeds. Other motors may be used as alternatives. For example, a variable speed stepper motor, brush motor or induction motor may be used.

Figure 19:
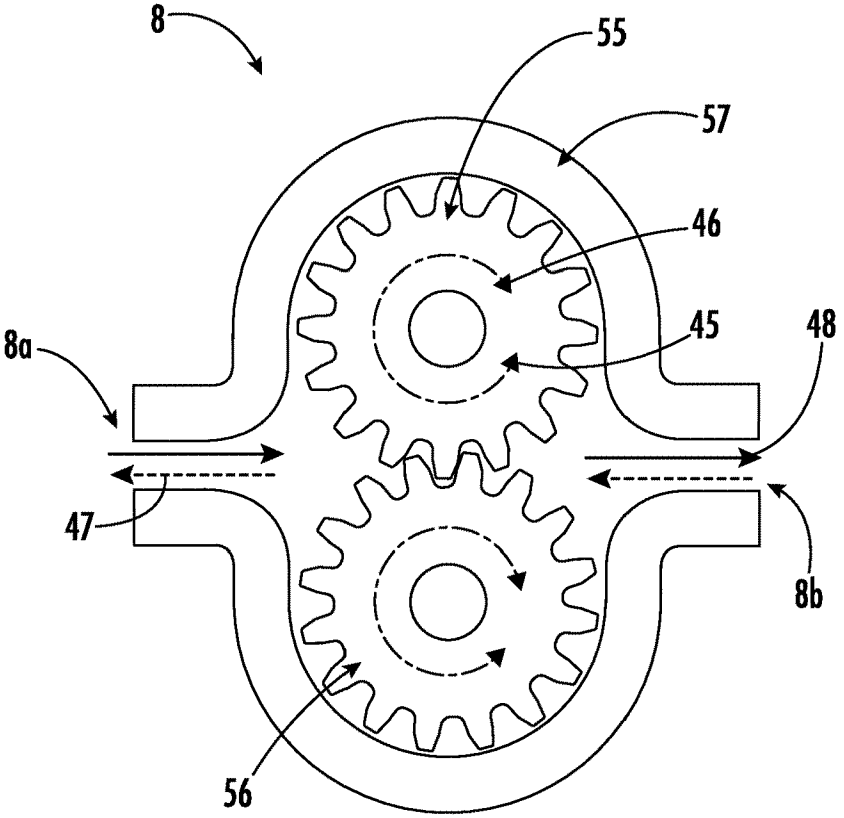
FIG. 19 is a cross-sectional view of an embodiment of the bi-directional pump shown in FIG. 5.

As shown in further detail in FIG. 19, in this embodiment pump 8 is a fixed displacement bi-directional internal two-port gear pump. The pumping elements, namely gears 55 and 56, are capable of rotating in either direction, thereby allowing hydraulic fluid to flow in either direction 47 or 48. This allows for oil to be added into and out of the system as the system controller closes the control loop of position or pressure. The shaft of gear 55 is connected to output shaft 52 of motor 10, with the other pump gear 56 following. Fluid is directed to flow to the outside of gears 55 and 56, between the outer gear teeth of gears 55 and 56 and housing 57, respectively. Thus, rotation of gear 55 in clockwise direction 46 causes fluid flow in one direction 48, from port 8*a* out port 8*b*. Rotation of gear 55 in counterclockwise direction 45 cause fluid flow in opposite direction 47, from port 8*b* out port 8*a*. Thus, the direction of flow of pump 8 depends on the direction of rotation of rotor 50 and output shaft 52 about axis x-x. In addition, the speed and output of pump 8 is variable with variations in the speed of motor 10. Other bi-directional pumps may be used as alternatives. For example, a variable displacement pump may be used.

Downhole electronics 95 receives commands, such as a valve open or a valve close command, and power from surface level controller 11 via cable 12. Downhole electronics 95 includes controller 74, power distribution component 70, motor controller drive electronics 71 to control and commutate motor 10, and solenoid drive electronics 72 to energize and control solenoid valves 34 and 35. Controller 74 receives feedback from sensors in the system via sensor interface 73. Controller 74 communicates with surface platform control electronics 11 via data and power cable 12.

In this embodiment, the position of sleeve collar 60 fixed to the end of rod 5 of piston assembly 92 is monitored via position sensors 40*a* and 40*b*, and the position signals are then fed back to controller 74. While in this embodiment position sensors 40*a* and 40*b* are shown as limit switches, other position sensor may be used as alternatives and such positions sensors may be placed in alternative locations in the assembly. For example, and without limitation, a magnetostrictive linear position sensor or an LVDT position sensor may be used as alternatives.

Figure 6:
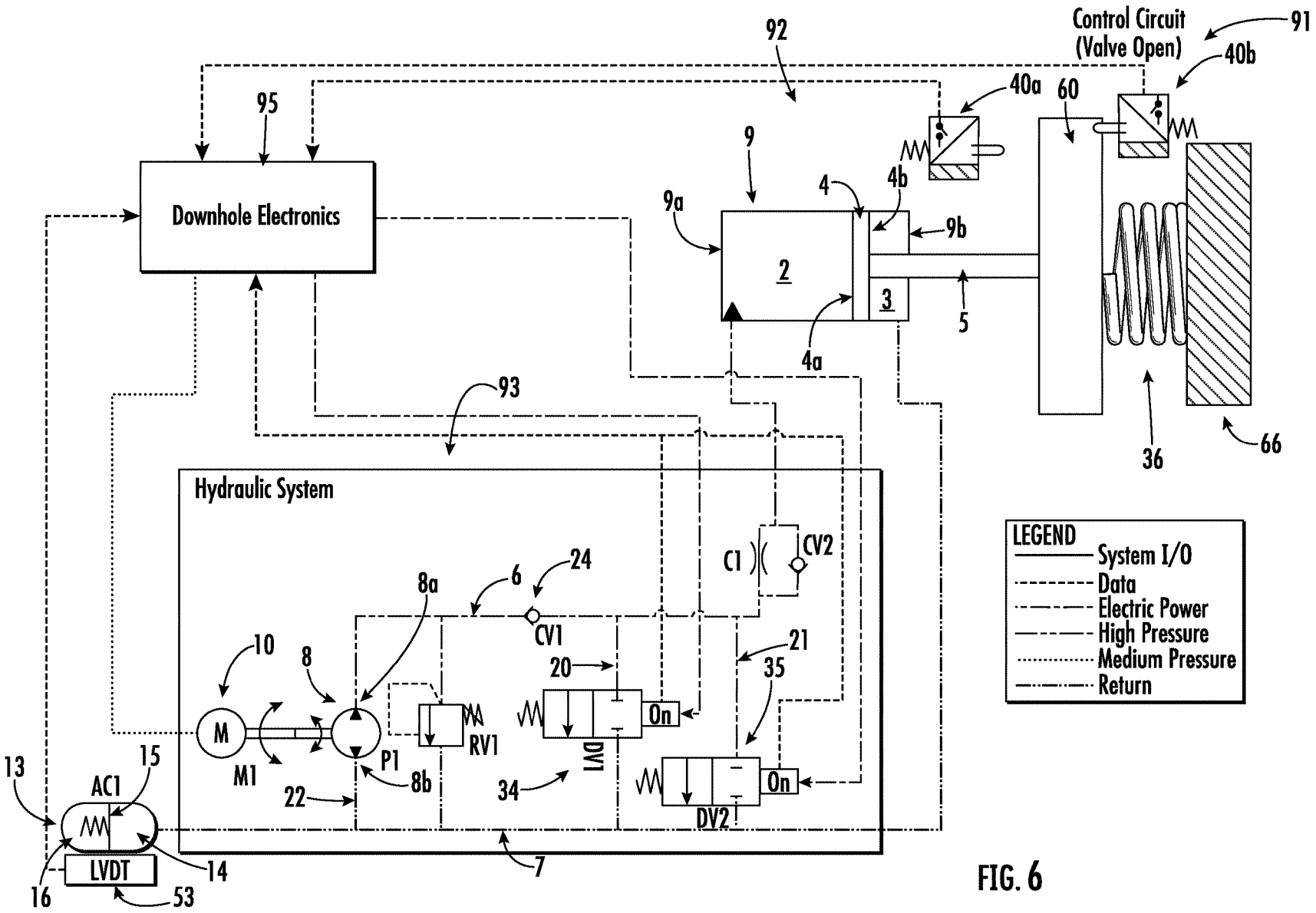
FIG. 6 is a detailed schematic view of the hydraulics of the embodiment of the safety valve actuator system shown in FIG. 5 in a valve open state.

As shown in FIGS. 2 and 6, hydraulic piston assembly 92 includes piston 4 slidably disposed within cylindrical housing 9. Rod 5 is mounted to piston 4 for movement with piston 4 and extends to the right and sealably penetrates right end wall 9*b* of cylinder 9. Piston 4 is slidably disposed within cylinder 9, and sealingly separates left chamber 2 from right chamber 3. In this embodiment, almost all of leftwardly-facing circular vertical end surface 4*a* of piston 4 faces into left chamber 2. However, only annular rightwardly-facing vertical end surface 4*b* of piston 4 faces rightwardly into right chamber 3 due to the addition of rod 5 through chamber 3 and outside housing 9. This creates an unequal piston area configuration, with the surface area of face 4*a* being greater than the surface area of face 4*b*.

In this embodiment reservoir module 13 generally includes a piston type pressure compensator for the closed hydraulic fluid system. As shown, reservoir 13 is separated into two variable volume chambers 14 and 16 by piston 15, which is slidably disposed within a cylindrical housing. As the system fluid is displaced, piston 15 will move and displace the contents in chamber 16 on the other side. Piston 15 moves in the housing to ensure that the fluid inside is substantially equal to the ambient pressure outside the system. Chamber 16 is open to the outside environment and chamber or tank 14 operates as the hydraulic reservoir for system fluid and is sealed and pressure balanced from the outside environment 16 by piston 15. As shown, in this embodiment reservoir module 13 includes position sensor 53 configured to sense position of piston 15 in the cylindrical housing and communicating with controller 74. In this embodiment, sensor 53 is a LVDT position sensor.

Alternatively, and without limitation, reservoir 13 may employ a bladder type pressure compensator for the fluid system rather than a piston type. Such a compensator functions generally the same as the piston type, with the exception that the barrier between the system fluid in tank 14 and the outside environment in chamber 16 is an elastomeric bladder or diaphragm. The bladder is easy to move and ensures that the fluid inside is substantially equal to the ambient pressure outside the system.

As shown in FIGS. 2 and 3, downhole safety valve 91 generally comprises flapper 61 rotatable about hinge 62 into and out of flow channel 18, valve actuation sleeve 64 connected to one end of rod 5 by annular sleeve collar 60, and spring 36 acting between annular spring stop 66 in production tubing 16 and sleeve collar 60 fixed to rod 5 and piston 4. Spring stop 66 is fixed relative to flapper hinge 62 on tubing 16 and valve actuation sleeve 64 is free to slide axially within tubing 16 relative to hinge 62 with axial movement of piston 4 within cylinder 9. Spring 36 is compressed between annular spring stop 66 of tubing 16 and annular sleeve collar 60.

Piston 4, via piston rod 5, may be driven to force sleeve 64, via sleeve collar 60, to slide downward within tubing 16 and compress spring 36 and push valve flapper 61 downwards and counter-clockwise about hinge 62 and out of fluid channel 18 to open valve assembly 91. Via sleeve collar 60, connected to and moving with both rod 5 of piston assembly 92 and cylindrical sleeve 64 of valve assembly 91, spring 36 is configured to bias rod 5 towards a retracted position and safety valve 91 to a closed position. Thus, when hydraulic pressure is removed from chamber 2 of piston 4, spring 36 provides a spring force that drives sleeve 64, via collar 60, upwards and thereby allows flapper 61 to shut and close off fluid channel 18. Flapper valve 61 is orientated to open downwards and to close upwards such that the flow of fluid upwards in well channel 18 will act to push flapper 61 upwards about hinge axis 62 to shut or close. Thus, when it becomes necessary to close valve assembly 91, such as in an emergency situation, spring 36 is configured to provide a spring force that drives cylindrical sleeve 64 upwards to a position that allows flapper 61 to in turn rotate upwards about hinge axis 62 and into flow channel 18 and thereby block flow up through production tubing 16. In this way, valve assembly 91 is a failsafe valve that may be operated to isolate wellbore 18 in the event of an emergency.

A first embodiment hydraulic manifold 93 is shown in FIGS. 5-10. As shown, hydraulic manifold 93 generally comprises solenoid valve 34, solenoid 35, and a plurality of hydraulic lines 6, 7, 20, 21 and 22. Pump 8, chamber 2, chamber 3, tank 14, valve 34, valve and hydraulic flow lines 6, 7, 20, 21 and 22 form a closed fluid system.

In this embodiment, valves 34 and 35 are both active valves that employ an external actuation force to open or close, rather than passive valves in which the operational state of open or closed is determined by the fluid the valve controls (e.g. a check valve). In this embodiment valves 34 and 35 are two-way two-port solenoid valves. When valves 34 and 35 are energized, the valve is held blocked port and closed, thereby blocking flow in either direction through the valve. When valves 34 and 35 are de-energized, the spring of the solenoid valve will return it to an open position, thereby allowing equalization of fluid pressure on each side of the valve and flow through the valve in either direction. Thus, in the event of a power failure, valves 34 and 35 will open and allow equalization of fluid pressure on each side of the valve.

As shown in FIGS. 6-10, in hydraulic manifold embodiment 93, pump 8 is in fluid line 22 and one side or port 8*a* of pump 8 communicates with left chamber 2 via fluid lines 22 and 6, and the opposite side or port 8*b* of pump 8 communicates with right chamber 3 via fluid lines 22 and 7. Port 8*b* of pump 8 communicates with tank 14 via fluid lines 22 and 7. Right chamber 3 communicates with tank 14 via fluid line 7. Bypass fluid line 20 connects lines 6 and 7, and therefor connects chamber 2 to both tank 14 and chamber 3. Solenoid-operated valve 34 is provided in line 20. Bypass fluid line 20 and solenoid-operated valve 34 are provided in line 6 between side 8*a* of pump 8 and left chamber 2, and therefore provide a first fluid line between chamber 2 and reservoir tank 14 that bypasses and is independent to pump 8. Bypass fluid line 21 also connects lines 6 and 7, and therefor also connects chamber 2 to both tank 14 and chamber 3. Solenoid-operated valve 35 is provided in line 21. Bypass fluid line 21 and solenoid-operated valve 35 are provided in line 6 between side 8*a* of pump 8 and left chamber 2, and therefore provide a second fluid line between chamber 2 and reservoir tank 14 that bypasses and is independent to pump 8. Line 22 with pump 8 therein, line 20 with valve 34 therein, and line 21 with valve 35 therein, are therefore parallel hydraulic flow connections between chamber 2 and tank 14. Accordingly, solenoid-operated valve 34 and fluid line 20 are operatively configured to provide a first hydraulic release path between chamber 2 and reservoir tank 14. Solenoid-operated valve 35 and fluid line 21 are operatively configured to provide a second hydraulic release path between chamber 2 and reservoir tank 14. In addition, fluid line 22 and pump 8 could be configured to operatively provide a third hydraulic release path between chamber 2 and reservoir tank 14 if desired.

The system in this embodiment may be controlled in at least two operational states and at least two fail-safe states. As shown in FIG. 6, to extend rod 5 and open safety valve assembly 91, valve 34 is energized so the state of valve 35 is blocked port and closed, and valve 35 is energized so the state of valve 35 is blocked port and closed. Side 8*a* of pump 8 is therefore flow connected in at least one direction through line 6 to chamber 2. However, with valve 34 closed, chamber 2 is not flow connected through line 20 directly to reservoir 14, and with valve 35 closed, chamber 2 is not flow connected through line 21 directly to reservoir 14. Piston 4 will move right to extend rod 5 when bidirectional motor 10 is rotated a first direction, thereby rotating bidirectional pump 8 (namely driven gear 55) in direction 45 and drawing fluid flow through port 8*b* from lines 22 and 7. In this embodiment, such fluid is drawn via line 7 from chamber 3 and also from reservoir 14. One function of this configuration is to address the volumetric differences between opposed chambers 2 and 3. When piston 4 moves rightwardly within cylinder 9, the volume of fluid removed from collapsing right chamber 3 is less than the volume of fluid needed to supply expanding left chamber 2 absent reservoir tank 14 and line 7. Bidirectional pump 8 outputs fluid through port 8*a* into line 6. The fluid in line 6 flows into chamber 2, thereby creating a differential pressure on piston 4 between chamber 2 and chamber 3. This differential pressure is positive when the pressure in chamber 2 on piston 4 is greater than the opposed pressure in chamber 3 on piston 4. This differential pressure would be negative if the pressure in chamber 2 on piston 4 were less than the pressure in chamber 3 on piston 4. In this embodiment, since chamber 3 is always connected to reservoir 14, the differential pressure is always zero or positive. When such positive differential pressure, in this case the pressure in left chamber 2 on piston 4, is great enough to overcome the opposed spring force of spring 36, such pressure causes rod 5 to extend to the right. Since chamber 3 is always connected to reservoir 14, when this piston force exceeds the opposed spring force of spring 36, piston 4 moves to the right and extends rod 5, thereby compressing spring 36 and opening safety valve 91.

Figure 7:
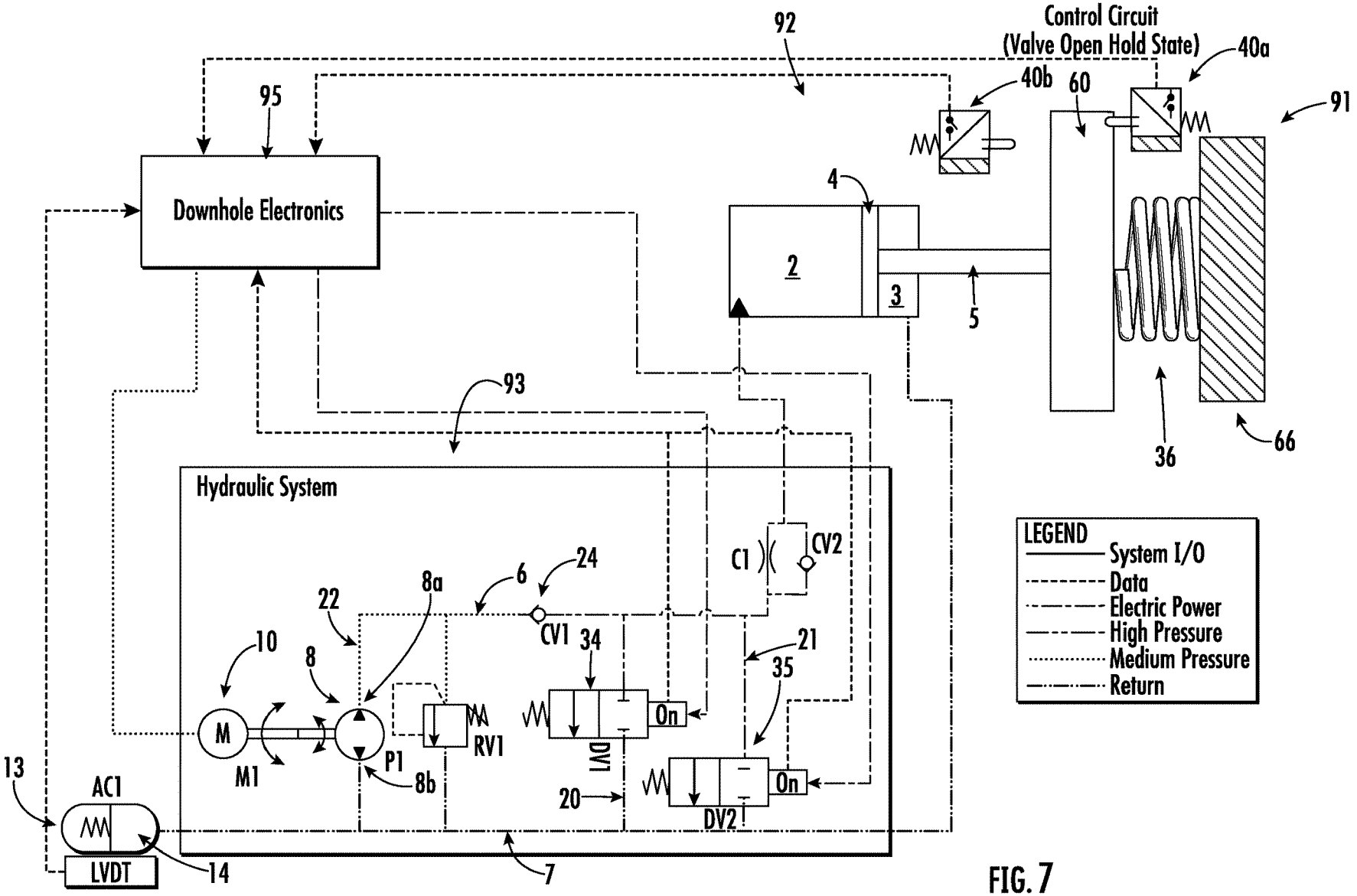
FIG. 7 is a detailed schematic view of the hydraulics of the embodiment of the safety valve actuator system shown in FIG. 6 in a valve hold open state.

As shown in FIG. 7, to maintain safety valve assembly 91 in an open state, valve 34 is energized so the state of valve 34 is blocked port and valve 35 is energized so the state of valve 35 is blocked port. In these valve states, fluid flow from left chamber 2 through lines 6 and 20 and through lines 6 and 21 and to tank 14, respectively, are blocked. In this embodiment, line 6 includes check valve 24 between port 8*a* of pump 8 and line 20 that allows fluid flow from port 8*a* of pump 8 to chamber 2, but blocks fluid flow from chamber 2 to line 22 and back all the way to port 8*a* of pump 8. Valve 24 is positioned so it does not block flow from chamber 2 to line 20 or line 21. This configuration thereby maintains pressure in left chamber 2 such that spring 36 is held compressed, piston 4 and rod 5 are not able to retract, and safety valve assembly 91 is held open. The hydraulic force on piston 4 is opposite and at least equal to the spring force of spring 36. With valve 24, such pressure is maintained independently of motor 10 and pump 8. Alternatively, valve 24 may be removed and motor 10 may be energized so pump 8 blocks flow through line 22 from chamber 2 to reservoir 14 to hold valve assembly 91 open.

Figure 8:
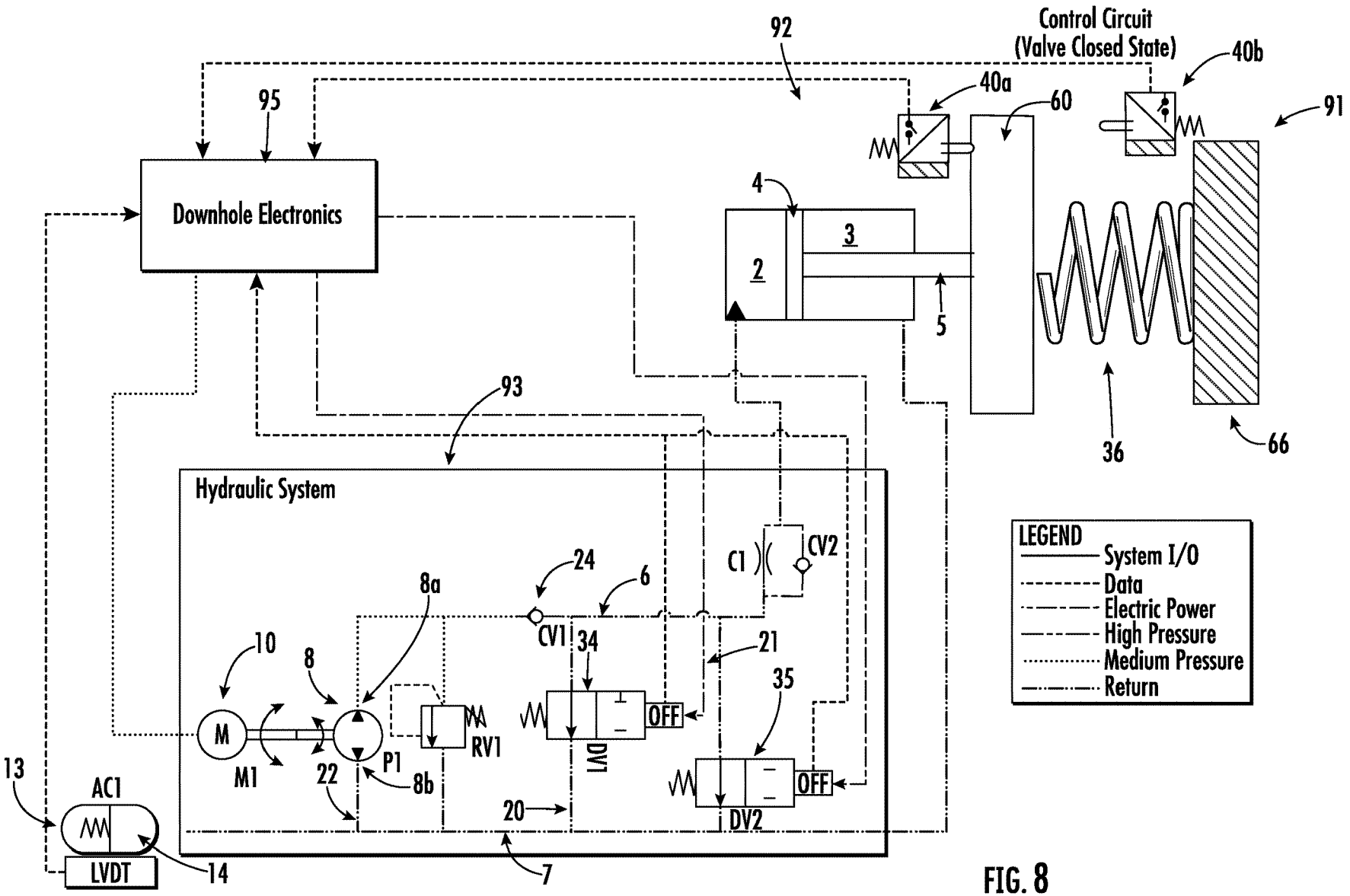
FIG. 8 is a detailed schematic view of the hydraulics of the embodiment of the safety valve actuator system shown in FIG. 6 in a valve close state.

As shown in FIG. 8, to retracted rod 5 and close valve 91, valves 34 and 35 are both deenergized. When valve 34 is de-energized, the spring of solenoid valve 34 will return it to an open position. In this open state, chamber 2 is flow connected through line 6 and line 20 to tank 14. When valve 35 is de-energized, the spring of solenoid valve 35 will return it to an open position. In this open state, chamber 2 is flow connected through line 6 and line 21 to tank 14. Collar 60 is biased by spring 36 to retract rod 5 and move piston 4 to the left and close valve assembly 91. When the pressure in left chamber 2 on piston 4 falls below the opposed spring force of spring 36, such spring force causes piston 4 to move to the left and fluid flows from chamber 2 through open lines 20 and 21 to tank 14 and chamber 3. In this embodiment, such fluid flows via line 7 into chamber 3 and also into reservoir 14. This configuration addresses the volumetric differences between opposed chambers 2 and 3. When piston 4 moves leftwardly within cylinder 9, the volume of fluid removed from collapsing left chamber 2 is greater than the volume of fluid needed to supply expanding right chamber 3 absent reservoir tank 14 and line 7.

Figure 9:
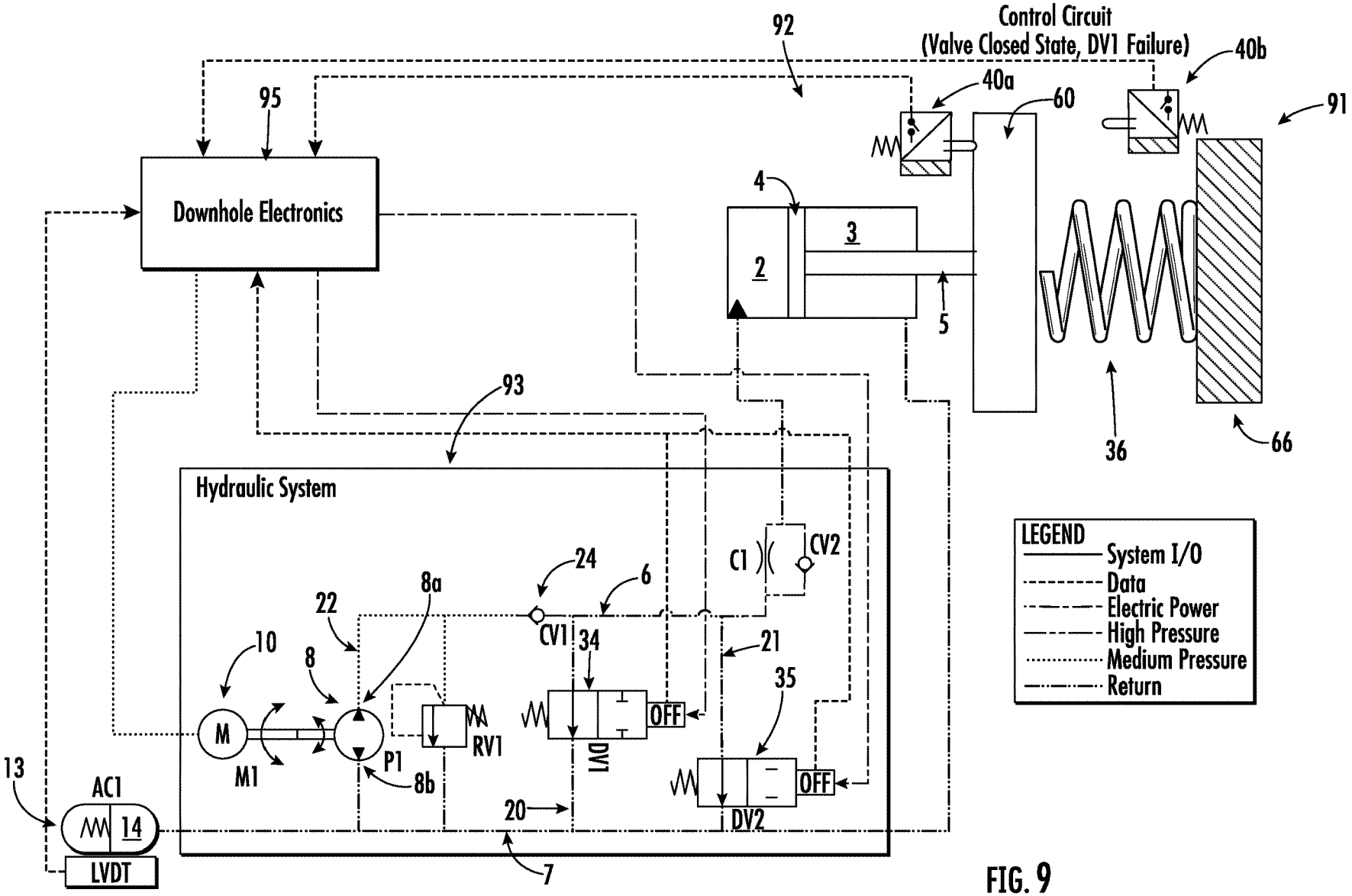
FIG. 9 is a detailed schematic view of the hydraulics of the embodiment of the safety valve actuator system shown in FIG. 6 in a valve close with a first fault state.

The system in this embodiment provides at least two fault redundant hydraulic paths for closing valve assembly 91 in the event of a fault or failure. First, as shown in FIG. 9, in the event of a flow restricting or blocking fault in motor 10, pump 8, and/or valve 34, valve 35 may be de-energized, even in an emergency power loss, and the spring of solenoid valve 35 will then return valve 35 to an open position. In this state, chamber 2 is flow connected through line 21 to line 7 and right chamber 3 and reservoir 14, thereby allowing pressure in chambers 2 and 3 to equalize. The spring force of spring 36 acts to retract rod 5 and move piston 4 to the left. The resulting pressurized fluid from chamber 2 flows via lines 6, 21 and 7 into chamber 3 and also into reservoir 14. This configuration addresses the volumetric differences between opposed chambers 2 and 3. When piston 4 moves leftwardly within cylinder 9, the volume of fluid removed from collapsing left chamber 2 is greater than the volume of fluid needed to supply expanding right chamber 2 absent reservoir tank 14 and line 7. When the pressure in left chamber 2 on piston 4 falls below the opposed spring force of spring 36, such spring force causes piston 4 to move to the left, retract rod 5, and close safety valve 91. Such valve closure of valve 91 does not require operation of motor 10, pump 8 and/or valve 34 and may therefore be provided even in the event of a flow restricting or blocking fault in motor 10, pump 8, and/or valve 34.

Figure 10:
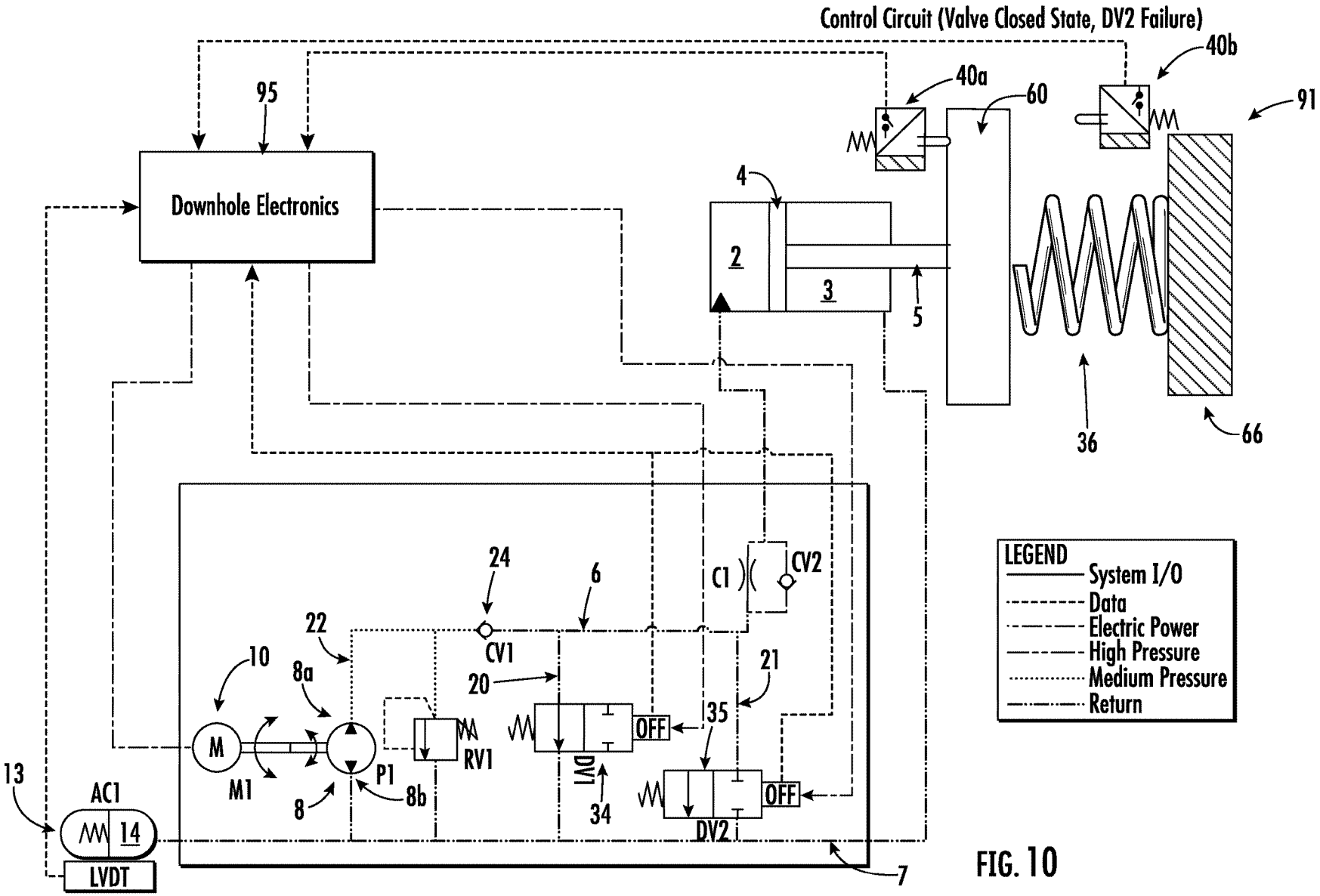
FIG. 10 is a detailed schematic view of the hydraulics of the embodiment of the safety valve actuator system shown in FIG. 6 in a valve close with a second fault state.

Second, as shown in FIG. 10, in the event of a flow restricting or blocking fault in motor 10, pump 8, and/or valve 35, valve 34 may be de-energized, even in an emergency power loss, and the spring of solenoid valve 34 will then return valve 34 to an open position. In this state, chamber 2 is flow connected through line 20 to line 7 and right chamber 3 and reservoir 14, thereby allowing pressure in chambers 2 and 3 to equalize. The spring force of spring 36 acts to retract rod 5 and move piston 4 to the left. The resulting pressurized fluid from chamber 2 flows via lines 6, 20 and 7 into chamber 3 and also into reservoir 14. This configuration addresses the volumetric differences between opposed chambers 2 and 3. When piston 4 moves leftwardly within cylinder 9, the volume of fluid removed from collapsing left chamber 2 is greater than the volume of fluid needed to supply expanding right chamber 2 absent reservoir tank 14 and line 7. When the pressure in left chamber 2 on piston 4 falls below the opposed spring force of spring 36, such spring force causes piston 4 to move to the left, retract rod 5, and close safety valve 91. Such valve closure of valve 91 does not require operation of motor 10, pump 8 or valve 35 and may therefore be provided even in the event of a flow restricting or blocking fault in motor 10, pump 8, and/or valve 35.

Figure 11:
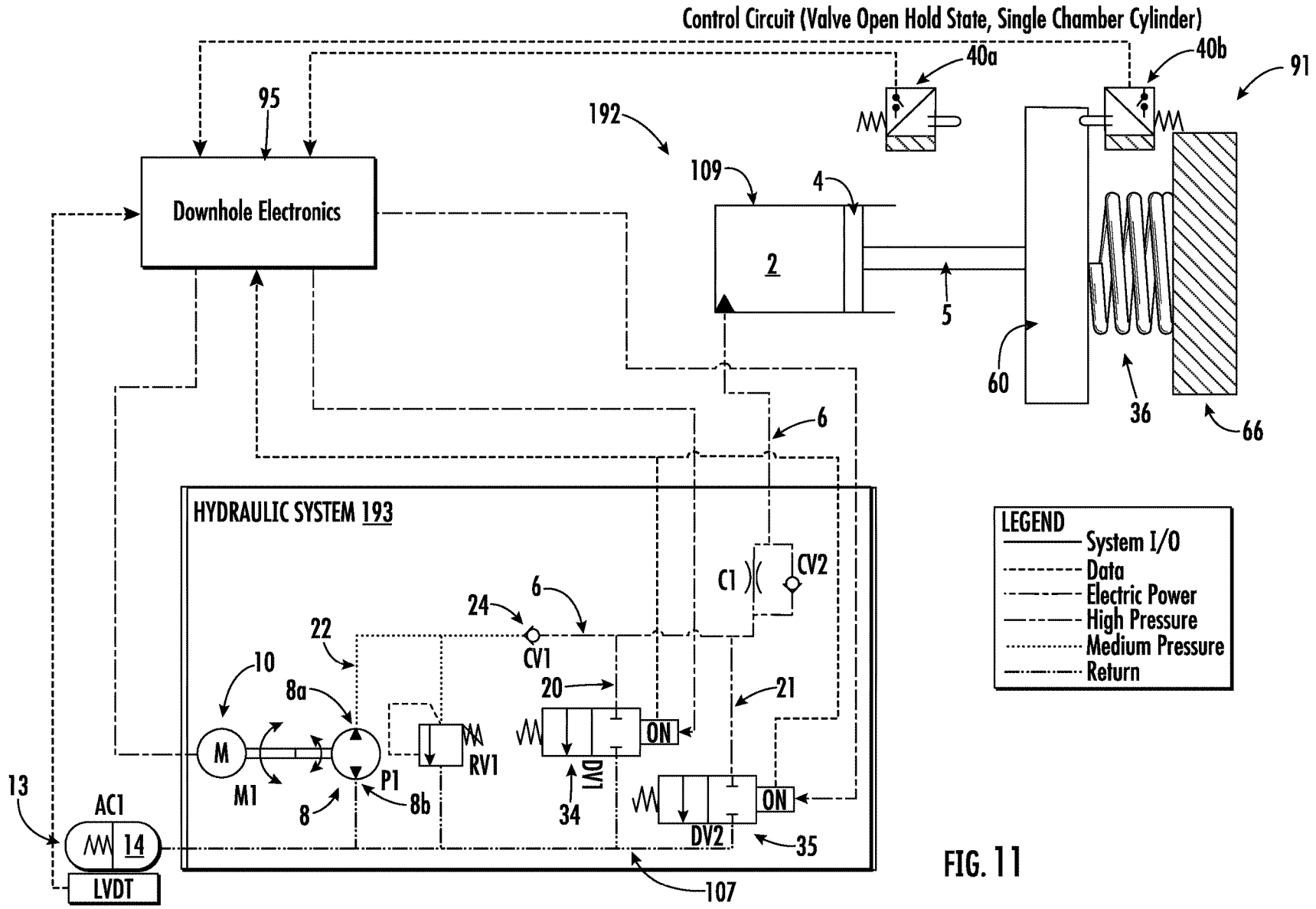
FIG. 11 is a detailed schematic view of a second embodiment of the hydraulics of the safety valve actuator system shown in FIG. 6, this view showing a single chamber hydraulic piston form.

A second embodiment hydraulic manifold 193 and piston assembly 192 are shown in FIG. 11. As shown, hydraulic manifold 193 is generally the same configuration as hydraulic manifold embodiment 93 and generally comprises solenoid valve 34, solenoid 35, and a plurality of hydraulic lines 6, 107, 20, 21 and 22. However, the piston assembly in this embodiment 192 contains only one single chamber in the closed fluid system. As shown, piston assembly 192 does not include second chamber 3 and only chamber 2 is in the closed fluid system with tank 14, valve 34, valve 35, and hydraulic flow lines 6, 107, 20, 21 and 22.

As shown in FIG. 11, in hydraulic manifold embodiment 193, pump 8 is in fluid line 22 and one side or port 8*a* of pump 8 communicates with single chamber 2 via fluid lines 22 and 6, and the opposite side or port 8*b* of pump 8 communicates only with tank 14 via fluid lines 22 and 107. Bypass fluid line 20 connects lines 6 and 107, and therefor connects chamber 2 to tank 14. Solenoid-operated valve 34 is provided in line 20. Bypass fluid line and solenoid-operated valve 34 are provided in line 6 between side 8*a* of pump 8 and left chamber 2, and therefore provide a first fluid line between chamber 2 and reservoir tank 14 that bypasses and is independent to pump 8. Bypass fluid line 21 also connects lines 6 and 107, and therefor also connects chamber 2 to both tank 14. Solenoid-operated valve 35 is provided in line 21. Bypass fluid line 21 and solenoid-operated valve 35 are provided in line 6 between side 8*a* of pump 8 and chamber 2, and therefore provide a second fluid line between chamber 2 and reservoir tank 14 that bypasses and is independent to pump 8. Line 22 with pump 8 therein, line 20 with valve 34 therein, and line 21 with valve 35 therein, are therefore parallel hydraulic flow connections between chamber 2 and tank 14. Accordingly, solenoid-operated valve 34 and fluid line 20 are operatively configured to provide a first hydraulic release path between chamber 2 and reservoir tank 14. Solenoid-operated valve 35 and fluid line 21 are operatively configured to provide a second hydraulic release path between chamber 2 and reservoir tank 14. In addition, fluid line 22 and pump 8 could be configured to operatively provide a third hydraulic release path between chamber 2 and reservoir tank 14 if desired.

The system in this embodiment may be controlled generally in the same manner described above with respect to first embodiment 93 to provide at least two operational states and two fail-safe states. As shown in FIG. 11, to extend rod 5 and open safety valve assembly 91, valve 34 is energized so the state of valve 35 is blocked port and closed, and valve 35 is energized so the state of valve 35 is blocked port and closed. Side 8*a* of pump 8 is therefore flow connected in at least one direction through line 6 to chamber 2, and chamber 2 is not flow connected through line 20 or 21 to reservoir 14. Piston 4 will move right to extend rod 5 when bidirectional motor 10 is rotated a first direction, thereby rotating bidirectional pump 8 (namely driven gear 55) in direction 45 and drawing fluid flow through port 8*b* from lines 22 and 107. In this embodiment, such fluid is drawn via line 107 only from reservoir 14. Bidirectional pump 8 outputs fluid through port 8*a* into line 6. The fluid in line 6 flows into chamber 2, thereby applying pressure on piston 4. When the pressure in sole chamber 2 on piston 4 is great enough to overcome the opposed spring force of spring 36, such pressure causes rod 5 to extend to the right. When this piston force exceeds the opposed spring force of spring 36, piston 4 moves to the right and extends rod 5, thereby compressing spring 36 and opening safety valve 91. As with embodiment 93, this configuration may also be used to maintain pressure in left chamber 2 such that spring 36 is held compressed, piston 4 and rod 5 are not able to retract, and safety valve assembly 91 is held open. The hydraulic force on piston 4 is maintained opposite and at least equal to the spring force of spring 36. With valve 24, such pressure is maintained independently of motor and pump 8.

As with embodiment 93, in the event of a flow restricting or blocking fault in motor 10, pump 8, and/or one of valves 34 or 35, the other of valves 34 or 35 may be de-energized, even in an emergency power loss, and the spring of the subject solenoid valve will then return the subject valve to an open position. In these fault states, chamber 2 is flow connected through line 20 or line 21 to line 107, but sole chamber 2 is not connected to a second chamber. The spring force of spring 36 still acts to retract rod 5 and move piston 4 to the left. The resulting pressurized fluid from sole chamber 2 flows via lines 6, 107 and valve 34 or 35 into reservoir 14 and the configuration does not need to address any volumetric differences between opposed chambers as in embodiment 92. When the pressure in left chamber 2 on piston 4 falls below the opposed spring force of spring 36, such spring force causes piston 4 to move to the left, retract rod 5, and close safety valve 91. Such valve closure of valve 91 does not require operation of motor 10, pump 8 or valve 34 or 35 and may therefore be provided even in the event of a flow restricting or blocking fault in motor 10, pump 8, and/or valve 34 or 35.

A third embodiment hydraulic manifold 293 is shown in FIGS. 12-16. As shown, hydraulic manifold 293 generally comprises solenoid valve 234, solenoid 35, and a plurality of hydraulic lines 206, 7, 21 and 22. Pump 8, chamber 2, chamber 3, tank 14, valve 234, valve 35 and hydraulic flow lines 206, 7, 21 and 22 form a closed fluid system.

As shown in FIGS. 12-16, in this hydraulic manifold embodiment 293, pump 8 is in fluid line 22 and one side or port 8*a* of pump 8 communicates with left chamber 2 via fluid lines 22 and 206, and the opposite side or port 8*b* of pump 8 communicates with right chamber 3 via fluid lines 22 and 7. Port 8*b* of pump 8 also communicates with tank 14 via fluid lines 22 and 7. Right chamber 3 communicates with tank 14 via fluid line 7. Solenoid-operated valve 234 is provided in line 206 between pump 8 and chamber 2. Fluid line 22, pump 8 and valve 234 connect lines 206 and 7, and therefor connects chamber 2 to both tank 14 and chamber 3. Fluid line 22, pump 8 and valve 234 provide a first fluid line between chamber 2 and reservoir tank 14. Such flow line does not bypass and is not independent to pump 8.

Bypass fluid line 21 also connects lines 206 and 7, and therefor also connects chamber 2 to both tank 14 and chamber 3. Solenoid-operated valve 35 is provided in line 21. Bypass fluid line 21 and solenoid-operated valve 35 are provided in line 206 between side 8*a* of pump 8 and left chamber 2, and therefore provide a second fluid line between chamber 2 and reservoir tank 14 that bypasses and is independent to both pump 8 and valve 234. Line 22 with pump 8 and valve 234 therein, and line 21 with valve 35 therein, are therefore parallel hydraulic flow connections between chamber 2 and tank 14. Accordingly, solenoid-operated valve 234, pump 8 and fluid line 22 are operatively configured to provide a first hydraulic release path between chamber 2 and reservoir tank 14. Solenoid-operated valve 35 and fluid line 21 are operatively configured to provide a second hydraulic release path between chamber 2 and reservoir tank 14.

Figure 12:
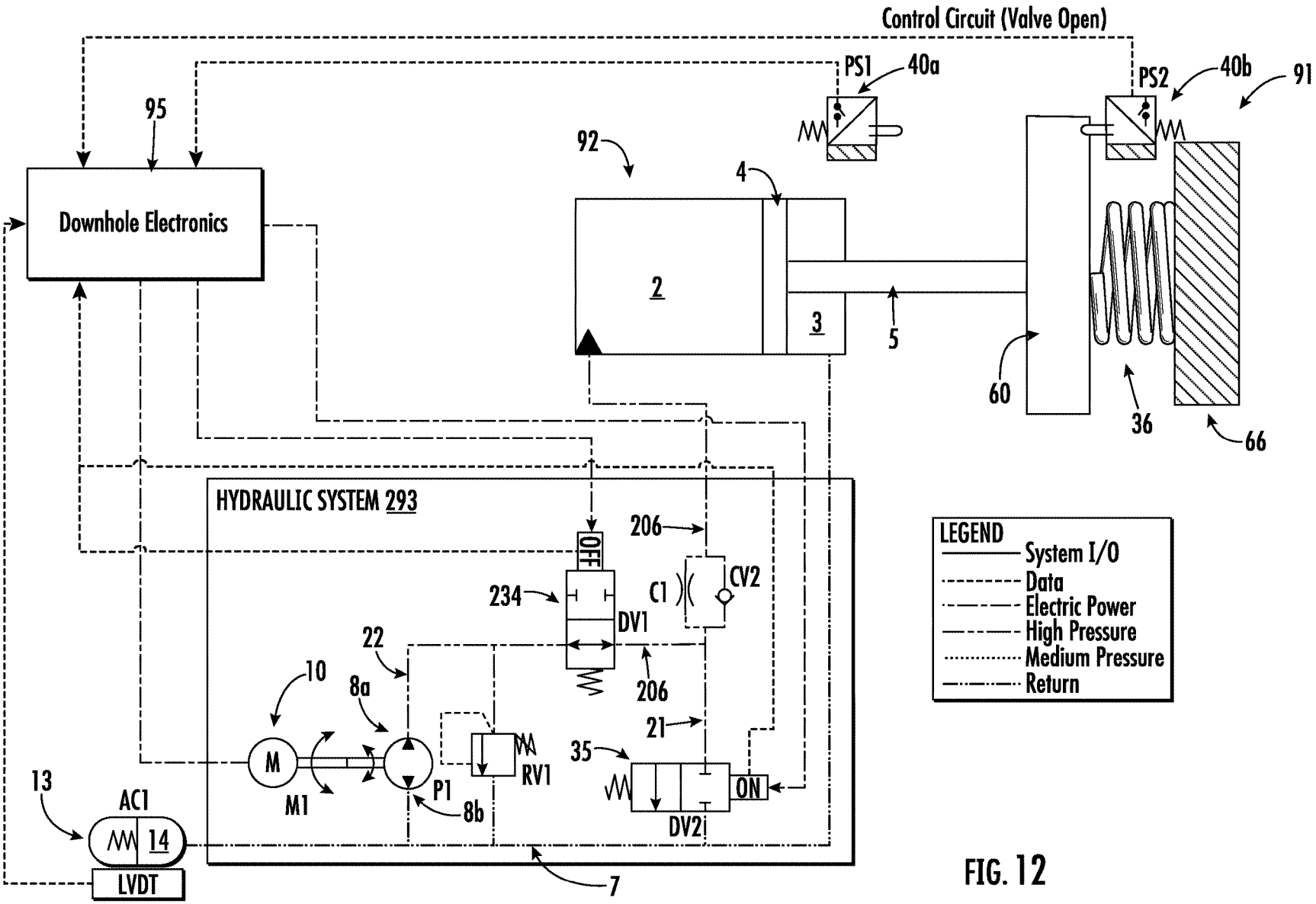
FIG. 12 is a detailed schematic view of a third embodiment of the hydraulics of the safety valve actuator system shown in FIG. 6 in a valve open state.

The system in this embodiment may be controlled in at least two operational states and at least two fail-safe states. As shown in FIG. 12, to extend rod 5 and open safety valve assembly 91, valve 234 is deenergized. When valve 234 is de-energized, the spring of solenoid valve 234 will return it to an open position. In this open state, chamber 2 is flow connected through line 206 to side 8*a* of pump 8. However, valve 35 is energized so the state of valve 35 is blocked port and closed. With valve 35 closed, chamber 2 is not flow connected through line 21 directly to reservoir 14. Piston 4 will move right to extend rod 5 when bidirectional motor 10 is rotated in a first direction, thereby rotating bidirectional pump 8 (namely driven gear 55) in direction 45 and drawing fluid flow through port 8*b* from lines 22 and 7. In this embodiment, such fluid is drawn via line 7 from chamber 3 and also from reservoir 14. One function of this configuration is to address the volumetric differences between opposed chambers 2 and 3. When piston 4 moves rightwardly within cylinder 9, the volume of fluid removed from collapsing right chamber 3 is less than the volume of fluid needed to supply expanding left chamber 2 absent reservoir tank 14 and line 7. Bidirectional pump 8 outputs fluid through port 8*a* into line 206. The fluid in line 206 flows into chamber 2, thereby creating a differential pressure on piston 4 between chamber 2 and chamber 3. This differential pressure is positive when the pressure in chamber 2 on piston 4 is greater than the opposed pressure in chamber 3 on piston 4. When such positive differential pressure, in this case the pressure in left chamber 2 on piston 4, is great enough to overcome the opposed spring force of spring 36, such pressure causes rod 5 to extend to the right. Since chamber 3 is always connected to reservoir 14, when this piston force exceeds the opposed spring force of spring 36, piston 4 moves to the right and extends rod 5, thereby compressing spring 36 and opening safety valve 91.

Figure 13:
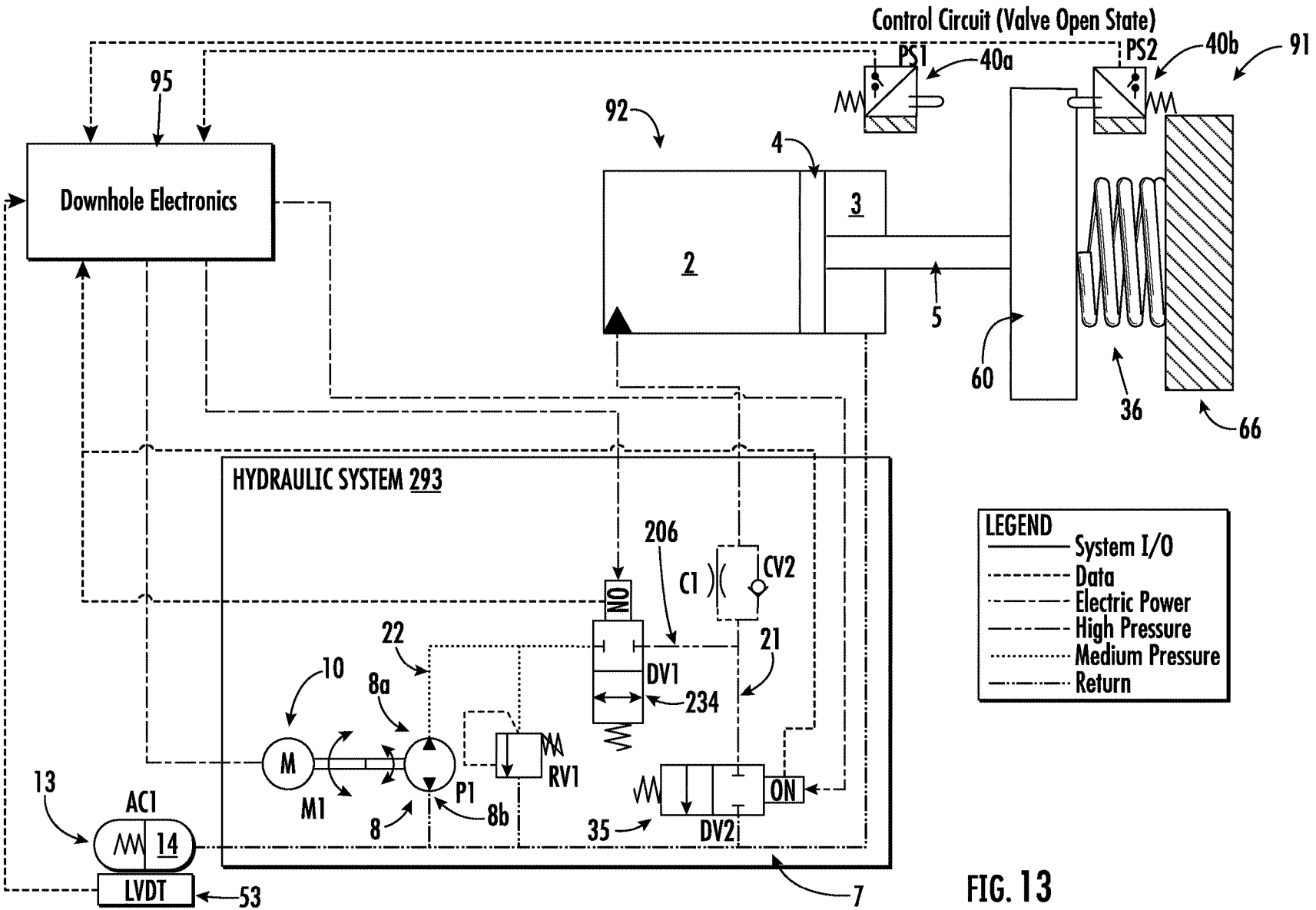
FIG. 13 is a detailed schematic view of the hydraulics of the embodiment of the safety valve actuator system shown in FIG. 12 in a valve hold open state.

As shown in FIG. 13, to maintain safety valve assembly 91 in an open state, valve 34 is energized so the state of valve 34 is blocked port and valve 35 is energized so the state of valve 35 is blocked port. In these valve states, fluid flow from left chamber 2 through lines 206 and 21 to pump 8 and tank 14, respectively, are blocked, thereby maintaining pressure in left chamber 2 such that spring 36 is held compressed, piston 4 and rod 5 are not able to retract, and safety valve assembly 91 is held open. The hydraulic force on piston 4 is opposite and at least equal to the spring force of spring 36. With valve 234, such pressure is maintained independently of motor 10 and pump 8.

To retract rod 5 and close valve assembly 91 in a rate-controlled manner, valve 234 is deenergized. When valve 234 is de-energized, the spring of solenoid valve 234 will return it to an open position. In this open state, chamber 2 is flow connected through lines 206 and 22 to port 8*a* of pump 8. However, valve 35 is energized so the state of valve 35 is blocked port, so chamber 2 is not directly flow connected through line 21 to reservoir 14 and chamber 3. The spring force of spring 36 acts to retract rod 5 and move piston 4 to the left. Piston 4 will move left to retract rod 5 when bidirectional motor 10 is rotated in a second direction, thereby rotating bidirectional pump 8 in direction 46 and allowing fluid flow through port 8*a* from line 206 and chamber 2. Bidirectional pump 8 also outputs fluid from port 8*b* into line 7. In this embodiment, such fluid flows via line 7 into chamber 3 and also flows into reservoir 14. This configuration addresses the volumetric differences between opposed chambers 2 and 3. Thus, motor 10 and pump 8 may be used to meter the flow of fluid from left chamber 2 and thereby the rate at which safety valve assembly 91 closes.

Figure 14:
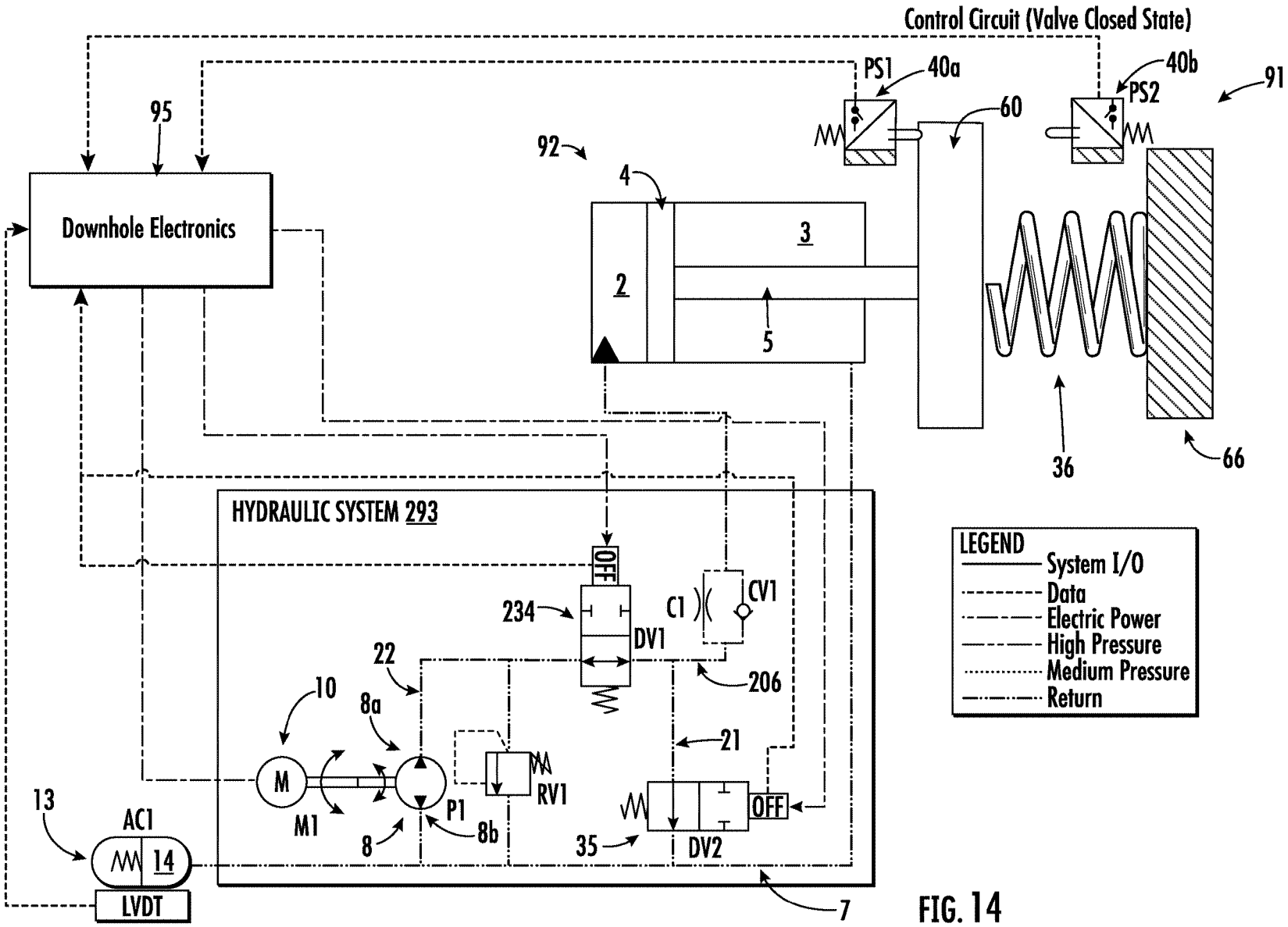
FIG. 14 is a detailed schematic view of the hydraulics of the embodiment of the safety valve actuator system shown in FIG. 12 in a valve close state.
Figure 15:
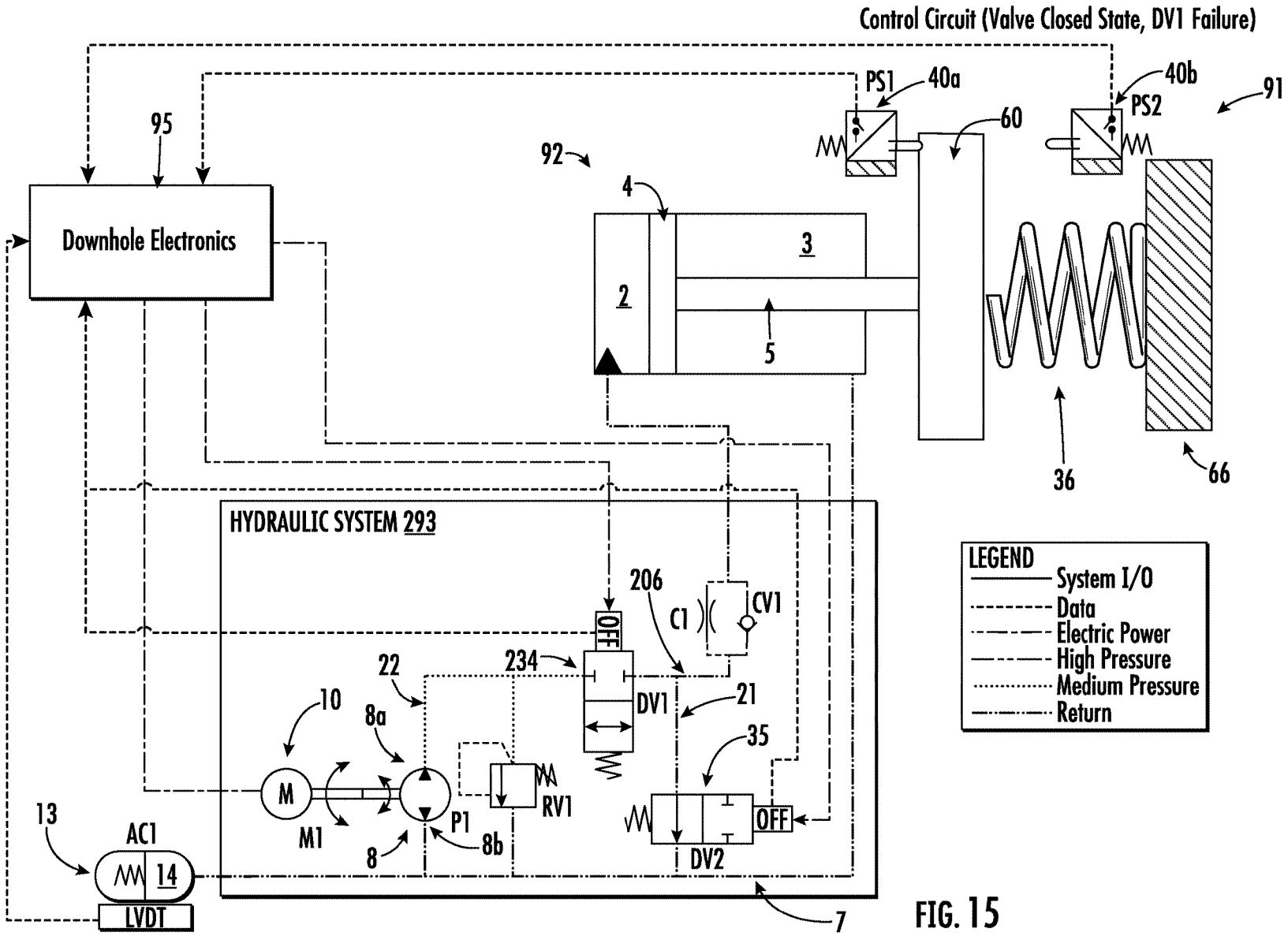
FIG. 15 is a detailed schematic view of the hydraulics of the embodiment of the safety valve actuator system shown in FIG. 12 in a valve close with a first fault state.

As shown in FIG. 14, to retracted rod 5 and close valve 91, both valves 234 and may be deenergized. When valve 234 is de-energized, the spring of solenoid valve 234 will return it to an open position. In this open state, chamber 2 is flow connected through line 22 and pump 8 to tank 14. When valve 35 is de-energized, the spring of solenoid valve 35 will return it to an open position. In this open state, chamber 2 is flow connected through line 21 to tank 14. Collar 60 is biased by spring 36 to retract rod 5 and move piston 4 to the left and close valve assembly 91. When the pressure in left chamber 2 on piston 4 falls below the opposed spring force of spring 36, such spring force causes piston 4 to move to the left and fluid flows from chamber 2 through open pump 8 and open lines 22 and 21 to tank 14 and chamber 3. In this embodiment, such fluid flows via line 7 into chamber 3 and also into reservoir 14. This configuration addresses the volumetric differences between opposed chambers 2 and 3.

The system in this embodiment provides at least two fault redundant hydraulic paths for closing valve assembly 91 in the event of a fault or failure. First, as shown in FIG. in the event of a flow restricting or blocking fault in motor 10, pump 8, and/or valve 234, valve 35 may be de-energized, even in an emergency power loss, and the spring of solenoid valve 35 will then return valve 35 to an open position. In this state, chamber 2 is flow connected through line 21 to line 7 and right chamber 3 and reservoir 14, thereby allowing pressure in chambers 2 and 3 to equalize. The spring force of spring 36 acts to retract rod 5 and move piston 4 to the left. The resulting pressurized fluid from chamber 2 flows via lines 206, 21 and 7 into chamber 3 and also into reservoir 14. This configuration addresses the volumetric differences between opposed chambers 2 and 3. When the pressure in left chamber 2 on piston 4 falls below the opposed spring force of spring 36, such spring force causes piston 4 to move to the left, retract rod 5, and close safety valve assembly 91. Such valve closure of valve 91 does not require operation of motor 10, pump 8 and/or valve 234 and may therefore be provided even in the event of a flow restricting or blocking fault in motor 10, pump 8, and/or valve 234.

Figure 16:
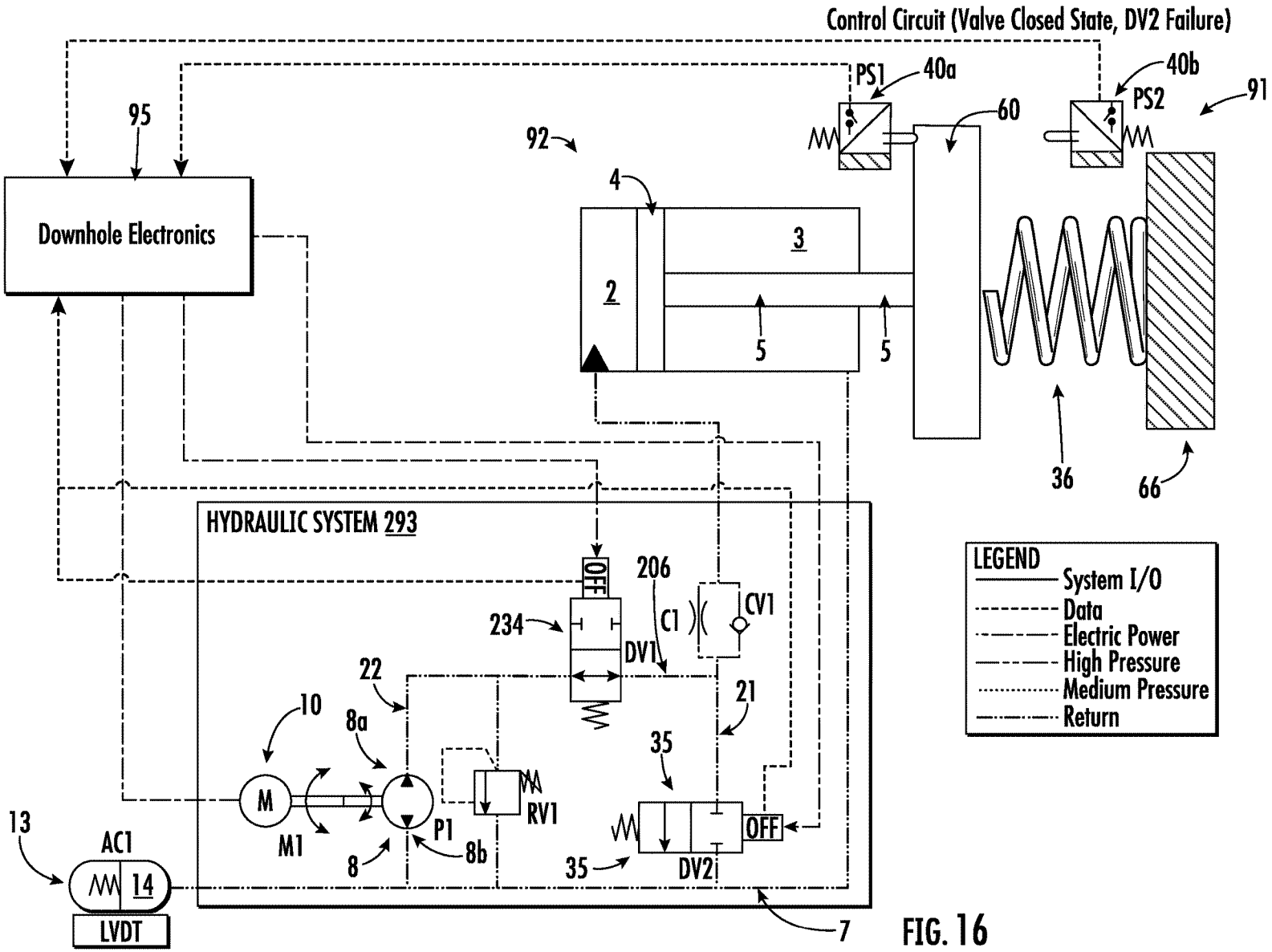
FIG. 16 is a detailed schematic view of the hydraulics of the embodiment of the safety valve actuator system shown in FIG. 12 in a valve close with a second fault state.

Second, as shown in FIG. 16, in the event of a flow restricting or blocking fault in valve 35, valve 234 may be de-energized, even in an emergency power loss, and the spring of solenoid valve 234 will then return valve 234 to an open position. In this state, chamber 2 is flow connected through line 206 to port 8*a* of pump 8. Even if there is a fault in valve 35 and it does not open, and even if motor 10 and pump 8 fail but fail open, such that gears 55 and 56 are free to rotate and thereby allow hydraulic fluid to flow from port 8*a* to port 8*b*, chamber 2 is flow connected through line 206, pump 8 and lines 22 and 7 to right chamber 3 and reservoir 14, thereby allowing pressure in chambers 2 and 3 to equalize. The spring force of spring 36 acts to retract rod 5 and move piston 4 to the left. The resulting pressurized fluid from chamber 2 flows via line 6, pump 8 and lines 22 and 7 into chamber 3 and also into reservoir 14. This configuration addresses the volumetric differences between opposed chambers 2 and 3. When the pressure in left chamber 2 on piston 4 falls below the opposed spring force of spring 36, such spring force causes piston 4 to move to the left, retract rod 5, and close safety valve assembly 91. Such valve closure of valve assembly 91 does not require operation of valve 35 and may therefore be provided even in the event of a flow restricting or blocking fault in valve 35.

Figure 17:
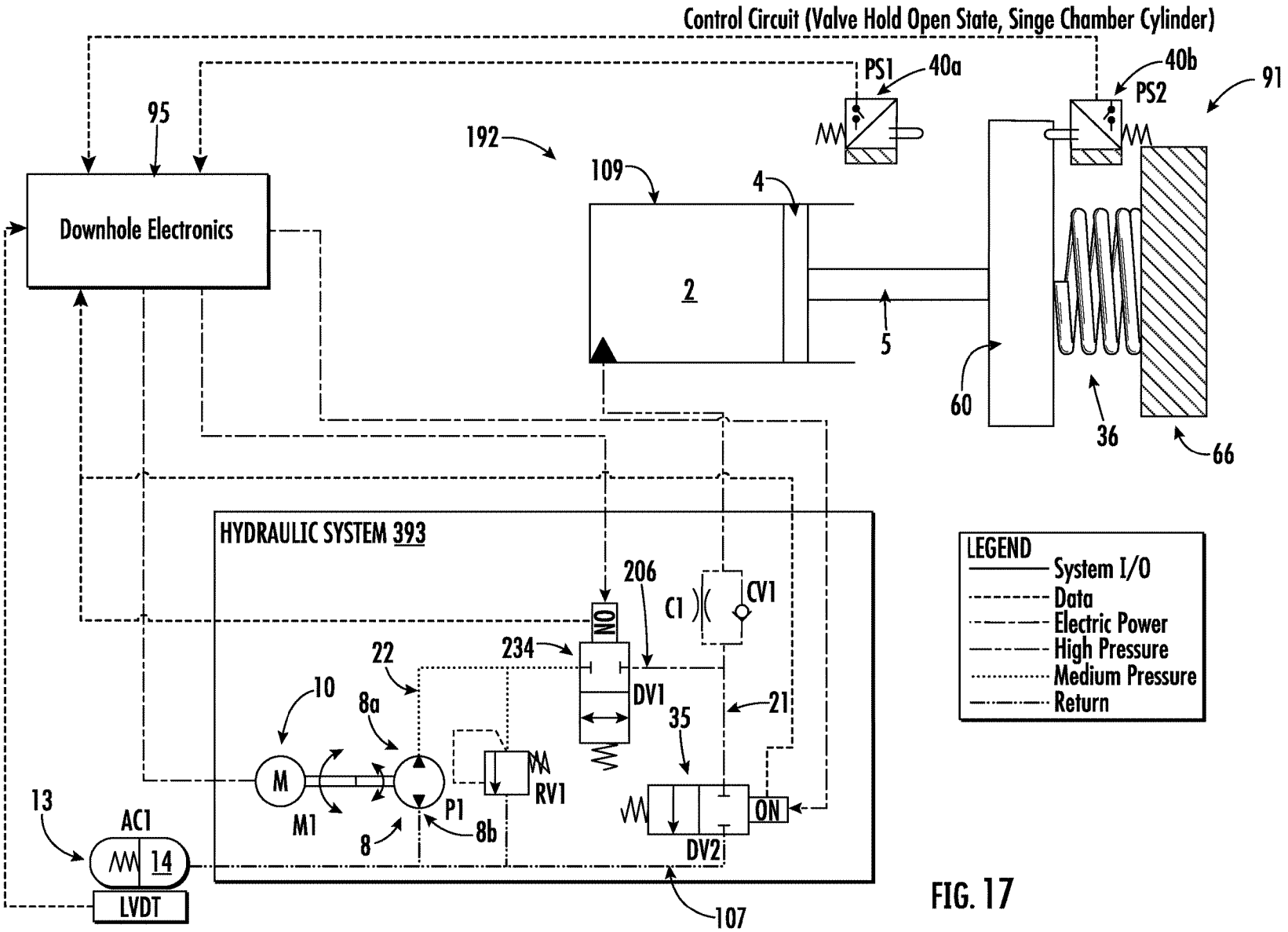
FIG. 17 is a detailed schematic view of a fourth embodiment of the hydraulics of the safety valve actuator system shown in FIG. 6, this view showing a single chamber hydraulic piston form.

A fourth embodiment hydraulic manifold 393 is shown in FIG. 17. As shown, hydraulic manifold 393 is generally the same configuration as hydraulic manifold embodiment 293 and generally comprises solenoid valve 234, solenoid 35, and a plurality of hydraulic lines 206, 107, 21 and 22. However, the piston assembly in this embodiment is the same as piston assembly 192 shown in FIG. 11, containing only one single chamber in the closed fluid system. As shown, piston assembly 192 does not include second chamber 3 and only chamber 2 is in the closed fluid system with tank 14, valve 234, valve 35, and hydraulic flow lines 206, 107, 21 and 22.

As shown in FIG. 17, in hydraulic manifold embodiment 393, pump 8 is in fluid line 22 and one side or port 8*a* of pump 8 communicates with single chamber 2 via fluid line 22, pump 8 and fluid line 206, and the opposite side or port 8*b* of pump 8 communicates only with tank 14 via fluid lines 22 and 107. Line 206, solenoid-operated valve 234, pump 8, and lines 22 and 107 provide a first fluid line between chamber 2 and reservoir tank 14 that does not bypass and is not independent to pump 8. Bypass fluid line 21 and solenoid-operated valve 35 are provided in line 6 between side 8*a* of pump 8 and chamber 2, and therefore provide a second fluid line between chamber 2 and reservoir tank 14 that bypasses and is independent to pump 8 and valve 234. Line 22 with pump 8 and valve 234 therein, and line 21 with valve 35 therein, are therefore parallel hydraulic flow connections between chamber 2 and tank 14. Accordingly, solenoid-operated valve 234, pump 8 and fluid line 22 are operatively configured to provide a first hydraulic release path between chamber 2 and reservoir tank 14. Solenoid-operated valve 35 and fluid line 21 are operatively configured to provide a second hydraulic release path between chamber 2 and reservoir tank 14.

The system in this embodiment may be controlled generally in the same manner described above with respect to embodiment 293 to provide at least two operational states and two fail-safe states. To extend rod 5 and open safety valve assembly 91, valve 234 is deenergized so the state of valve 35 is open, and valve 35 is energized so the state of valve 35 is blocked port and closed. Side 8*a* of pump 8 is therefore flow connected in at least one direction through valve 234 to chamber 2. Chamber 2 is not flow connected through line 21 to reservoir 14. Only side 8*b* of pump 8 is flow connected to reservoir 14. Piston 4 will move right to extend rod 5 when bidirectional motor 10 is rotated a first direction, thereby rotating bidirectional pump 8 (namely driven gear 55) in direction 45 and drawing fluid flow through port 8*b* from lines 22 and 107 and reservoir 14. In this embodiment, such fluid is drawn via line 107 only from reservoir 14. Bidirectional pump 8 outputs fluid through port 8*a* into line 206 and through open valve 234. The fluid in line 206 flows into chamber 2, thereby applying positive pressure on piston 4. When the pressure in sole chamber 2 on piston 4 is great enough to overcome the opposed spring force of spring 36, such pressure causes rod 5 to extend to the right. When this piston force exceeds the opposed spring force of spring 36, piston 4 moves to the right and extends rod 5, thereby compressing spring 36 and opening safety valve 91.

As shown in FIG. 17, to maintain safety valve assembly 91 in an open state, valve 34 is energized so the state of valve 234 is blocked port and valve 35 is energized so the state of valve 35 is blocked port. In these valve states, fluid flow from left chamber 2 through lines 206 and 21 to pump 8 and tank 14, respectively, are blocked, thereby maintaining pressure in left chamber 2 such that spring 36 is held compressed, piston 4 and rod 5 are not able to retract, and safety valve assembly 91 is held open. The hydraulic force on piston 4 is opposite and at least equal to the spring force of spring 36. With valve 234, such pressure is maintained independently of motor 10 and pump 8.

As with embodiment 293, in the event of a flow restricting or blocking fault in one of valve 234 or valve 35, the other of valve 234 or 35 may be de-energized, even in an emergency power loss, and the spring of the subject solenoid valve will then return the subject valve to an open position. In these fault states, chamber 2 is flow connected through pump 8 and line 22 or through line 21, as the case may be, to line 107 and tank 14, and chamber 2 is not connected to a second chamber. The spring force of spring 36 still acts to retract rod 5 and move piston 4 to the left. The resulting pressurized fluid from sole chamber 2 flows via line 206, valve 234. line 22 and line 107 or via line 206, valve 35, line 21 and line 107, into reservoir 14. The configuration does not need to address any volumetric differences between opposed chambers as in embodiment 92. When the pressure in left chamber 2 on piston 4 falls below the opposed spring force of spring 36, such spring force causes piston 4 to move to the left, retract rod 5, and close safety valve assembly 91.

Because the configuration does not need to address any volumetric differences between opposed chambers, the system in this embodiment may also be controlled to provide at least a third operational state. To selectively retract rod 5 at a variable or controlled rate or to position safety valve 91 between its open and closed position, valve 234 is deenergized so the state of valve 35 is open, and valve 35 is energized so the state of valve 35 is blocked port and closed. Side 8*a* of pump 8 is therefore flow connected in at least one direction through valve 234 to chamber 2. Chamber 2 is not flow connected through line 21 to reservoir 14. Only side 8*b* of pump 8 is flow connected to reservoir 14. Piston 4 will move left to retract rod 5 when bidirectional motor 10 is rotated a second direction, thereby rotating bidirectional pump 8 in direction 46 and drawing fluid flow through port 8*a* from line 206 and chamber 2. In this embodiment, such fluid is drawn only from chamber 2. Bidirectional pump 8 outputs fluid through port 8*b* into line 107 and, with valve 35 closed, only into reservoir 14. When the pressure in sole chamber 2 on piston 4 falls below the opposed spring force of spring 36, piston 4 will move to the left, retract rod 5, and begin to close safety valve assembly 91. When a desired position of safety valve 91 between its open and closed positions is reached, valve 234 may be energized and closed to retain such position if desired. Thus, motor 10 and pump 8 may be used to variably control the pressure in chamber 2 and the flow rate of fluid into and out of chamber 2, and thereby the rate at which safety valve assembly 91 opens or closes and the position of safety valve assembly 91 in either direction.

Figure 18:
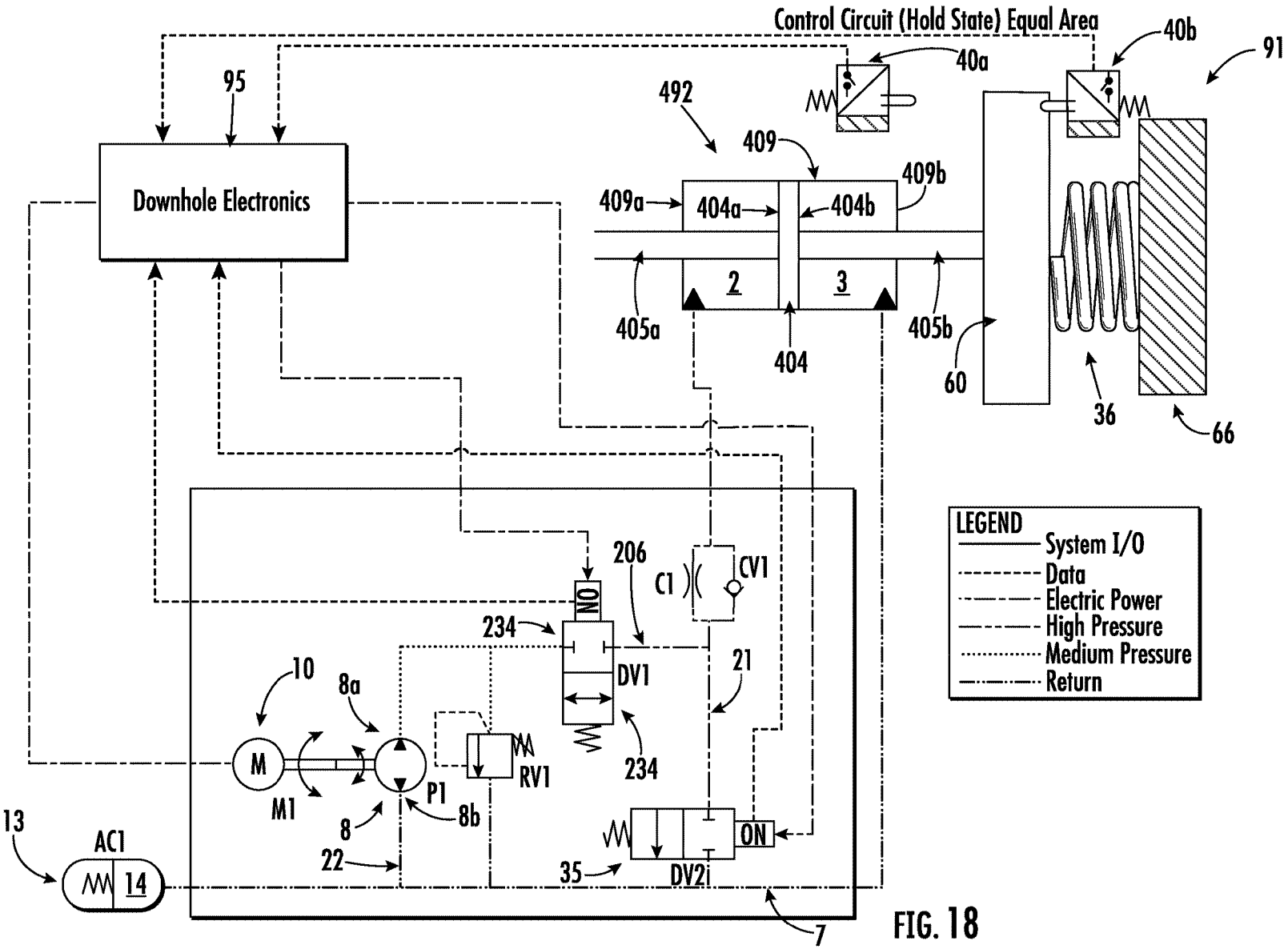
FIG. 18 is a detailed schematic view of a fifth embodiment of the hydraulics of the safety valve actuator system shown in FIG. 6, this view showing an equal piston area and dual rod form.

A fifth embodiment hydraulic piston assembly 493 is shown in FIG. 18. This embodiment is similar to the embodiment shown in FIG. 13, but with dual rod and equal area piston assembly 493. As shown, piston 404 includes opposed rods 405*a* and 405*b* mounted to piston 404 for movement with piston 404. Rod 405*b* extends to the right and penetrates the right end wall 409*b* of housing 409. Rod 405*a* extends to the left and penetrates the left end wall 409*a* of housing 409. In this embodiment, leftwardly-facing annular vertical end surface 404*a* of piston 404 faces into left chamber 2 due to the addition of rod 405*a* through chamber 2, and rightwardly-facing annular vertical end surface 404*b* of piston 404 faces into right chamber 3 due to rod 405*b* extending through chamber 3 and outside housing 409. With rods 405*a* and 405*b* being of an equal diameter, this creates an equal piston area configuration, with the surface area of face 404*a* being substantially the same as the surface area of face 404*b*. In this embodiment, rod 405*b* is connected to collar 60 of safety valve assembly 91.

Safety valve 91 may include sensors 40*a* and 40*b* for position monitoring of actuator rod 5 and sleeve collar 60, compensator 13 may include sensor 153 for position monitoring of compensator piston 15, valve 34 may include sensor 43 for position monitoring of valve 34, valve 35 may include sensor 44 for position monitoring of valve 35, and hydraulic system 93 may include pressure sensor 41 for pressure monitoring of hydraulic system 93. Such sensors may be used to provide downhole diagnostic functions in subsurface safety valve 90 by way of controller 74. Controller 74 is a digital device which has output lines that are a logic function of its input lines, examples of which include a microprocessor, microcontroller, field programmable gate array, programmable logic device, application specific integrated circuit, or other similar device. Controller 74 is configured to perform a variety of computer-implemented functions, such as performing method steps and calculations, and storing relevant data, as disclosed herein. For communicating with the various sensors, sensor interface 73 permits signals transmitted from the sensors to be converted into signals that can be understood and processed by processor 74. The sensors may be coupled to sensor interface 73 via a wired connection. In other embodiments they may be coupled to sensor interface 73 via a wireless connection. The diagnostic monitoring of subsurface safety valve 90 is implementable in controller 74. The programming can be embodied in any form of computer-readable medium or a special purpose computer or data processor that is programmed, configured or constructed to perform the subject instructions. Thus, downhole electronics 95 includes a processor, a non-transitory computer readable medium, and processor executable code stored on the non-transitory computer readable medium. The processor may be implemented as a single processor or multiple processors working together or independently to execute the processor executable code described herein. Some examples of processors are microprocessors, microcontrollers, central processing units (CPUs), peripheral interface controllers (PICs), programmable logic controllers (PLCs), microcomputers, digital signal processors (DSPs), programmable logic devices ("PLDs"), multi-core processors, field programmable gate arrays (FPGAs), and combinations thereof. The term computer or processor as used herein refers to any of the above devices as well as any other data processor. A computer readable medium comprises a medium configured to store or transport computer readable code, or in which computer readable code may be embedded. The non-transitory computer readable medium can be implemented in any suitable manner, such as via random access memory (RAM), read only memory (ROM), a hard drive, a hard drive array, a solid state drive, a memory device, a magnetic drive, a flash drive, flash memory, a memory card, an optical drive, or other similar devices or medium. The non-transitory computer readable medium can be a single non-transitory computer readable medium, or multiple non-transitory computer readable mediums functioning logically together or independently. The computer systems described herein are for purposes of example only. The described embodiments and methods may be implemented in any type of computer system or programming or processing environment. In addition, it is meant to encompass processing that is performed in a distributed computing environment, were tasks or modules are performed by more than one processing device. Persons skilled in the art will recognize that any computer system having suitable programming means will be capable of executing the steps of the disclosed methods as embodied in a program product. Persons skilled in the art will also recognize that, although some of the exemplary embodiments described in this specification are oriented to software installed and executing on computer hardware, nevertheless, alternative embodiments implemented as firmware or as hardware are well within the scope of the present disclosure.

Figure 21:
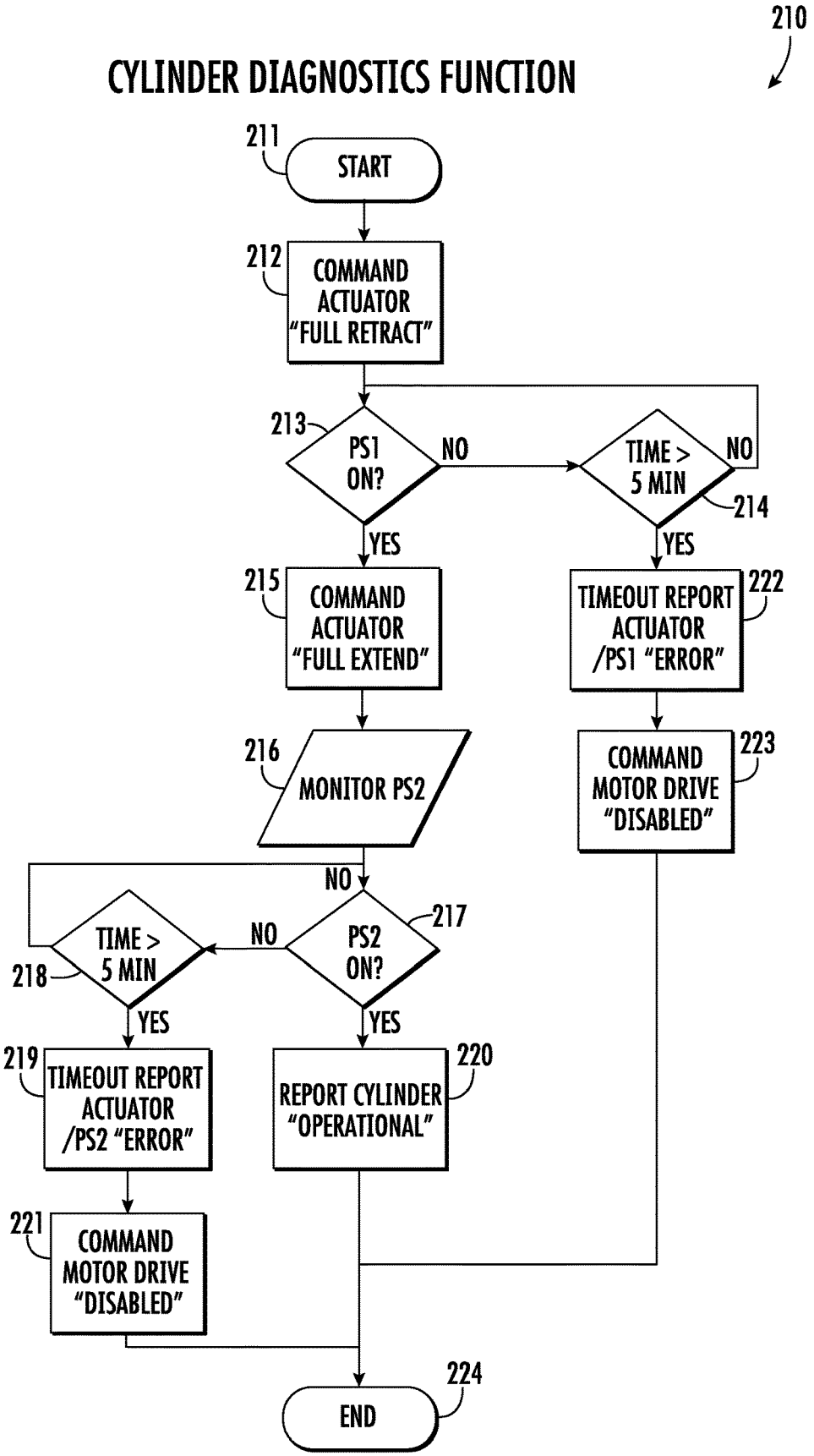
FIG. 21 is a flowchart illustrating an embodiment of a cylinder diagnostic function of the safety valve actuator system shown in FIG. 5.

System 90 thereby includes diagnostic instruction from and feedback to controller 74. FIG. 21 is a flowchart of an example method 210 of performing diagnostics on hydraulic piston assembly 92 implemented in controller 74 and diagnostic module 75. Method 210 may be embodied in computer readable code on the computer readable medium such that when the processor of controller 74 executes the computer readable code, the processor executes method 210. Method 210 is thus implemented as code stored on the non-transitory computer readable medium of controller 74 and controller 74 executes such processor executable code. With reference to FIG. 21, in step 211 of diagnostic function 210, a start signal is generated to activate the various steps of method 210 and the subject instructions stored on the non-transitory computer readable medium of controller 74. In step 212, controller 74 commands system 90 to fully retract actuator rod 5 and sleeve collar 60 and, with reference to FIG. 5, thereby move sleeve collar 60 to the left and to the position shown in FIG. 8. In blocks 213 and 214, controller 74 monitors sensor 40*a* for a defined period of time after commanding system 90 to the fully retracted position. In block 213, controller 74 determines if sleeve collar 60 has triggered proximity switch 40*a*, which would indicate that actuator rod is in the fully retracted position shown in FIG. 8. In block 214, controller 74 determines if a threshold period of time has been exceeded without sleeve collar 60 triggering proximity switch 40*a*. In this embodiment, such threshold period of time is five minutes, but alternative time thresholds may be employed as desired. If, after command 212, position sensor 40*a* is not activated within the stored time threshold, in step 222 controller 74 generates an "error" signal or report and in step 223 controller 74 commands motor drive 71 to a "disabled" state by turning off the output power at motor drive 71 so motor 10 can spin freely. On the other hand, if sleeve collar 60 triggers sensor 40*a* within the stored time threshold indicating that actuator rod 5 and sleeve collar 60 are in the commanded fully retracted position, in step 215 controller 74 commands system 90 to fully extend actuator rod and sleeve collar 60 and, with reference to FIG. 5, thereby move sleeve collar 60 to the right and to the position shown in FIG. 6. In step 216, controller 74 monitors position sensor for a change in state. In blocks 217 and 218, controller 74 monitors sensor 40*b* for a defined period of time after commanding system 90 to the fully extended position. In block 217, controller 74 determines if sleeve collar 60 has triggered proximity switch 40*b*, which would indicate that actuator rod is in the fully extended position shown in FIG. 6. In block 218, controller 74 determines if a threshold period of time has been exceeded without sleeve collar 60 triggering proximity switch 40*b*. In this embodiment, such threshold period of time is five minutes, but alternative time thresholds may be employed as desired. If, after command 215, position sensor 40*b* is not activated within the stored time threshold, in step 219 controller 74 generates an "error" signal or report and in step 221 controller 74 commands motor drive 71 to a "disabled" state. On the other hand, if sleeve collar 60 triggers sensor 40*b* within the stored time threshold indicating that actuator rod 5 and sleeve collar 60 are in the commanded fully extended position, in step 220 controller 74 generates an operational signal or report and hydraulic piston assembly 92 is diagnosed as being fully operational. Controller 74 thereby provides a built-in downhole hydraulic piston assembly 92 diagnostic routine that may run at selected and automated periodic intervals. If movement of the safety valve is not detected by either sensor 40*a* for the fully retracted command or sensor for the fully extended command within a given time threshold, then an error signal is provided by controller 74. Controller 74 may also provide a valve closure command and a "disabled" command may include power cutoff to solenoids 34 and 35 to place safety valve in a failsafe closed position. The error signal may be transmitted to surface controller 11 on platform 100 and if no errors are detected then controller 74 may send a confirming operational signal to surface controller 11 on platform 100. While in this embodiment the time threshold is greater than five minutes, other time thresholds may be employed depending on the desired operating parameters of the system.

Figure 22:
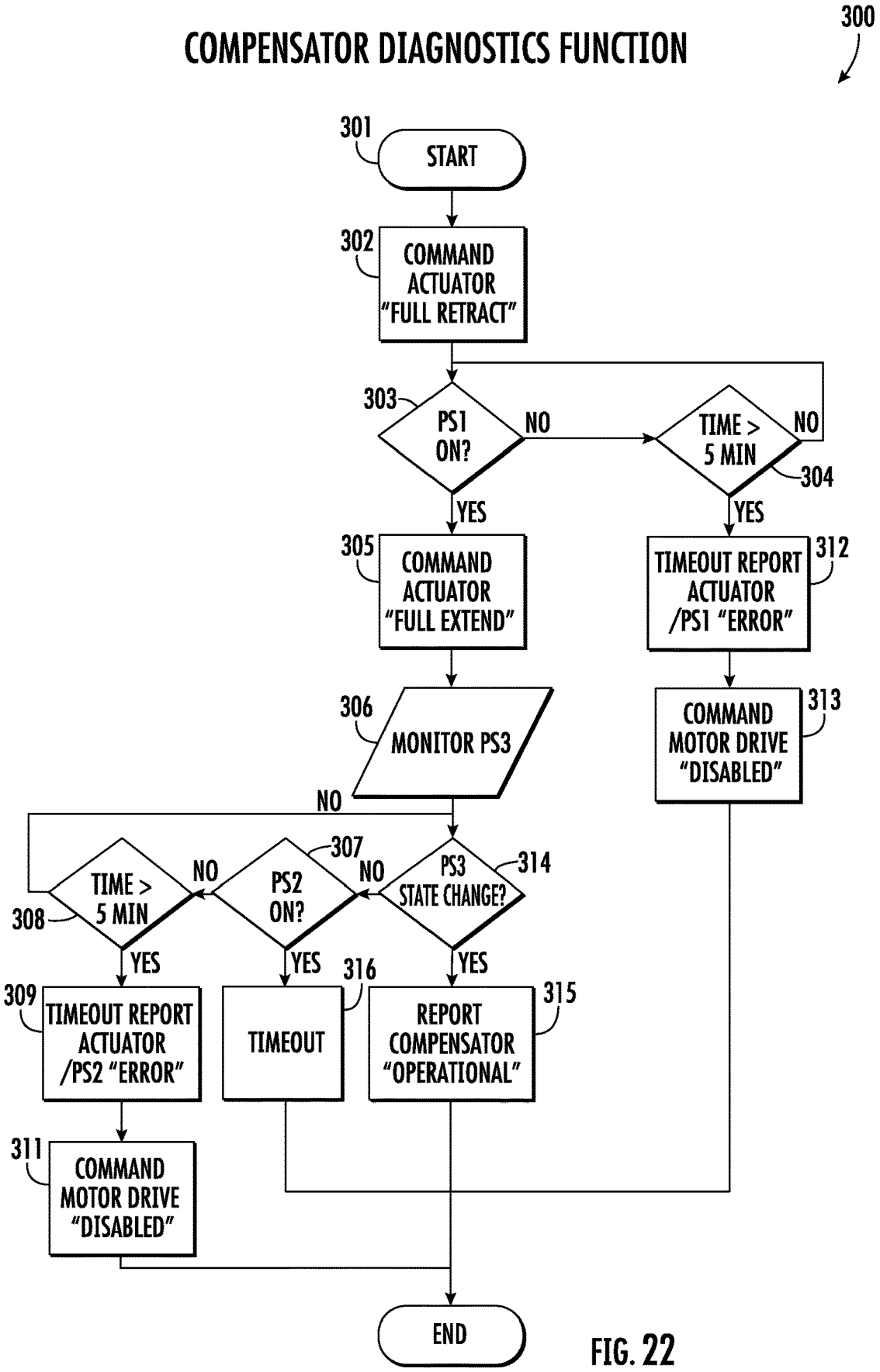
FIG. 22 is a flowchart illustrating an embodiment of a compensator diagnostic function of the safety valve actuator system shown in FIG. 5.

Controller 74 also includes in diagnostic module 75 compensator diagnostic function or routine 300 for determining whether compensated reservoir assembly 13 is operational. FIG. 22 is a flowchart of an example method 300 of performing diagnostics on compensated reservoir assembly 13 implemented in controller 74 and diagnostic module 75. Method 300 may be embodied in computer readable code on the computer readable medium such that when the processor of controller 74 executes the computer readable code, the processor executes method 300. Method 300 is thus implemented as code stored on the non-transitory computer readable medium of controller 74 and controller 74 executes such processor executable code. With reference to FIG. 22, in step 301 of diagnostic function 300, a start signal is generated to activate the various steps of method 300 and the subject instructions stored on the non-transitory computer readable medium of controller 74. In step 302, controller 74 commands system 90 to fully retract actuator rod 5 and sleeve collar 60 and, with reference to FIG. 5, thereby move sleeve collar 60 to the left and to the position shown in FIG. 8. In blocks 303 and 304, controller 74 monitors sensor 40*a* for a defined period of time after commanding system 90 to the fully retracted position. In block 303, controller 74 determines if sleeve collar 60 has triggered proximity switch 40*a*, which would indicate that actuator rod is in the fully retracted position shown in FIG. 8. In block 304, controller 74 determines if a threshold period of time has been exceeded without sleeve collar triggering proximity switch 40*a*. In this embodiment, such threshold period of time is five minutes, but alternative time thresholds may be employed as desired. If, after command 302, position sensor 40*a* is not activated within the stored time threshold, in step 312 controller 74 generates an "error" signal or report and in step 313 controller 74 commands motor drive 71 to a "disabled" state. On the other hand, if sleeve collar 60 triggers sensor 40*a* within the stored time threshold indicating that actuator rod 5 and sleeve collar 60 are in the commanded fully retracted position, in step 305 controller 74 commands system 90 to fully extend actuator rod 5 and sleeve collar 60 and, with reference to FIG. 5, thereby move sleeve collar to the right and to the position shown in FIG. 6. In step 306, controller 74 monitors compensator position sensor 153 for a change in state. In blocks 314, 307 and 308, controller 74 monitors sensor 153 and sensor 40*b* for a defined period of time after commanding system to the fully extended position. In block 314, sensor 153 is monitored for a change in state that would indicate movement of compensation piston 15. Because spring 36 is biased to increase pressure in closed hydraulic system 93 versus the pressure outside of closed hydraulic system 93, compensator piston 15 will move to compensate for such difference in pressure when actuator piston 4 is extending. Such movement is monitored by controller 74 via position sensor 153. If position sensor 153 indicates a change in position of compensator piston 15 in block 314, in step 315 controller 74 generates an operational signal or report and compensated reservoir assembly 13 is diagnosed as being fully operational. On the other hand, if position sensor does not sense a change in position of compensator piston 15 in block 314, in block 307, controller 74 determines if sleeve collar 60 has triggered proximity switch which would indicate that actuator rod is in the fully extended position shown in FIG. 6. In block 308, controller 74 determines if a threshold period of time has been exceeded without either a sensed change in position of compensator piston 15 or sleeve collar 60 triggering proximity switch 40*b*. In this embodiment, such threshold period of time is five minutes, but alternative time thresholds may be employed as desired. If, after command 305, neither position sensor 153 nor position sensor 40*b* are activated within the stored time threshold, in step 309 controller 74 generates an "error" signal or report and in step 311 controller 74 commands motor drive 71 to a "disabled" state. On the other hand, if sleeve collar 60 triggers sensor 40*b* within the stored time threshold indicating that actuator rod 5 and sleeve collar 60 are in the commanded fully extended position but sensor 153 has not detected a change in position of compensator piston 15, in step 316 controller 74 generates an "error" signal indicating a fault in sensor 153 or compensated reservoir assembly 13, or controller 74 may generate a timeout to halt the process and indicate that the actuator is not responding as intended and alternative diagnostics is required. Controller 74 thereby provides a built-in downhole compensated reservoir assembly 13 diagnostic routine that may run at selected and automated periodic intervals. Controller 74 may also provide a valve closure command and a "disabled" command may include power cutoff to solenoids 34 and to place safety valve 90 in a failsafe closed position. Error signals may be transmitted to surface controller 11 on platform 100 and if no errors are detected then controller 74 may send a confirming operational signal to surface controller 11 on platform 100. While in this embodiment the time threshold is greater than five minutes, other time thresholds may be employed depending on the desired operating parameters of the system.

Figure 23:
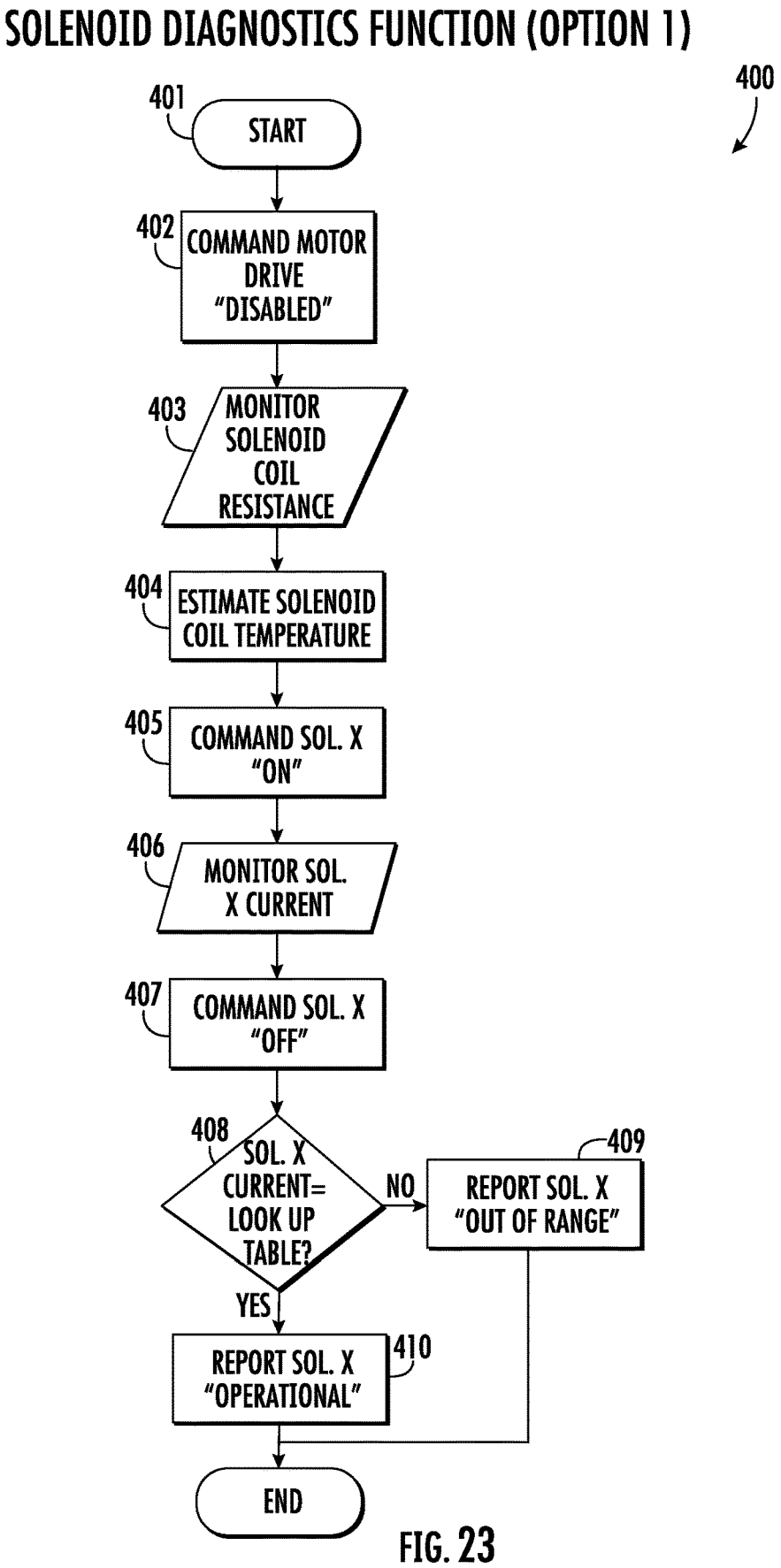
FIG. 23 is a flowchart illustrating a first embodiment of a solenoid diagnostic function of the safety valve actuator system shown in FIG. 5.

Controller 74 also includes in diagnostic module 75 solenoid valve diagnostic function or routine 400 for determining whether either solenoid valve 34 or solenoid valve 35 are operational. FIG. 23 is a flowchart of a first embodiment example method 400 of performing diagnostics on solenoid valves 34 and 35 implemented in controller 74 and diagnostic module 75. Method 400 may be embodied in computer readable code on the computer readable medium such that when the processor of controller 74 executes the computer readable code, the processor executes method 400. Method 400 is thus implemented as code stored on the non-transitory computer readable medium of controller 74 and controller 74 executes such processor executable code. In this embodiment, solenoid drive 72 includes solenoid sensor 76 and the resistance of the solenoid coil and the solenoid drive current of the subject solenoid valve 34 or 35 are used to determine the state of the subject solenoid valve 34 or 35. In particular, with reference to FIG. 23, in step 401 of diagnostic function 400, a start signal is generated to activate the various steps of method 400 and the subject instructions stored on the non-transitory computer readable medium of controller 74. In step 402, controller 74 commands motor drive 71 to a "disabled" state. In step 403, controller 74 monitors solenoid coil resistance of the subject solenoid valve and in step 404 controller 74 estimates solenoid coil temperature from such solenoid coil resistance. In step 405, controller 74 commands the subject solenoid valve 34 or 35 to an "on" or energized state via solenoid drive 72. In step 406, controller 74 monitors solenoid current. In step 407, controller 74 commands the subject solenoid valve 34 or 35 to an "off" or deenergized state via solenoid drive 72. If current sensor 76 indicates a current within an established range based on a lookup table stored in controller 74 in block 408, in step 410 controller 74 generates an operational signal or report and the subject solenoid valve 34 or 35 is diagnosed as being fully operational. On the other hand, if current sensor 76 indicates a current outside the established range based on the lookup table stored in controller 74 in block 408, in step 409 controller 74 generates an "error" or "out of range" signal or report indicating a fault in the subject solenoid valve 34 or 35.

Figure 24:
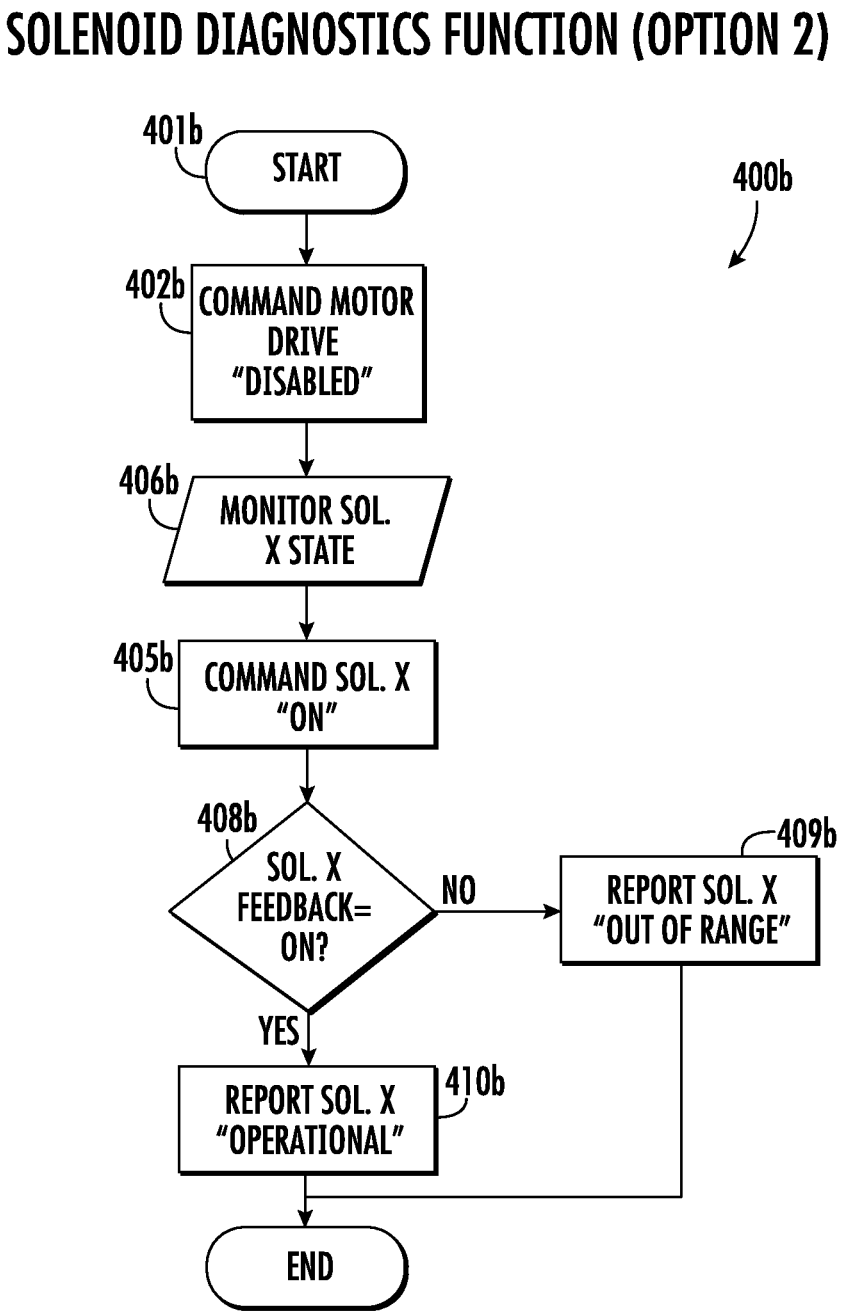
FIG. 24 is a flowchart illustrating a second embodiment of a solenoid diagnostic function of the safety valve actuator system shown in FIG. 5.

FIG. 24 is a flowchart of a second embodiment example method 400*b* of performing diagnostics on solenoid valves 34 and 35 implemented in controller 74 and diagnostic module 75. Method 400*b* may be embodied in computer readable code on the computer readable medium such that when the processor of controller 74 executes the computer readable code, the processor executes method 400*b*. Method 400*b* is thus implemented as code stored on the non-transitory computer readable medium of controller 74 and controller 74 executes such processor executable code. In this embodiment, solenoid valve 34 includes sensor 43 for position monitoring of valve 34 and solenoid valve 35 includes sensor 44 for position monitoring of valve 35. With reference to FIG. 24, in step 401*b* of diagnostic function 400*b*, a start signal is generated to activate the various steps of method 400*b* and the subject instructions stored on the non-transitory computer readable medium of controller 74. In step 402*b*, controller 74 commands motor drive 71 to a "disabled" state. In step 406*b*, controller 74 monitors position sensor 43 or 44, as the case may be. In step 405*b*, controller 74 commands the subject solenoid valve 34 or 35 to an "on" or energized state via solenoid drive 72. In block 408*b*, controller 74 determines if sensor 43 or 44 indicates that the valve element of solenoid valve 34 or 35, respectively, is open as commanded. If sensor 43 or 44 indicates in block 408*b* that valve 34 or 35, respectively, is in an open position as commanded, in step 410*b* controller 74 generates an operational signal or report and the subject solenoid valve 34 or 35 is diagnosed as being fully operational. On the other hand, if sensor 43 or 44 indicates in block 408*b* that valve 34 or 35, respectively, is not in an open position as commanded, in step 409*b* controller 74 generates an "error" or "out of range" signal or report indicating a fault in the subject solenoid valve 34 or 35.

Figure 25:
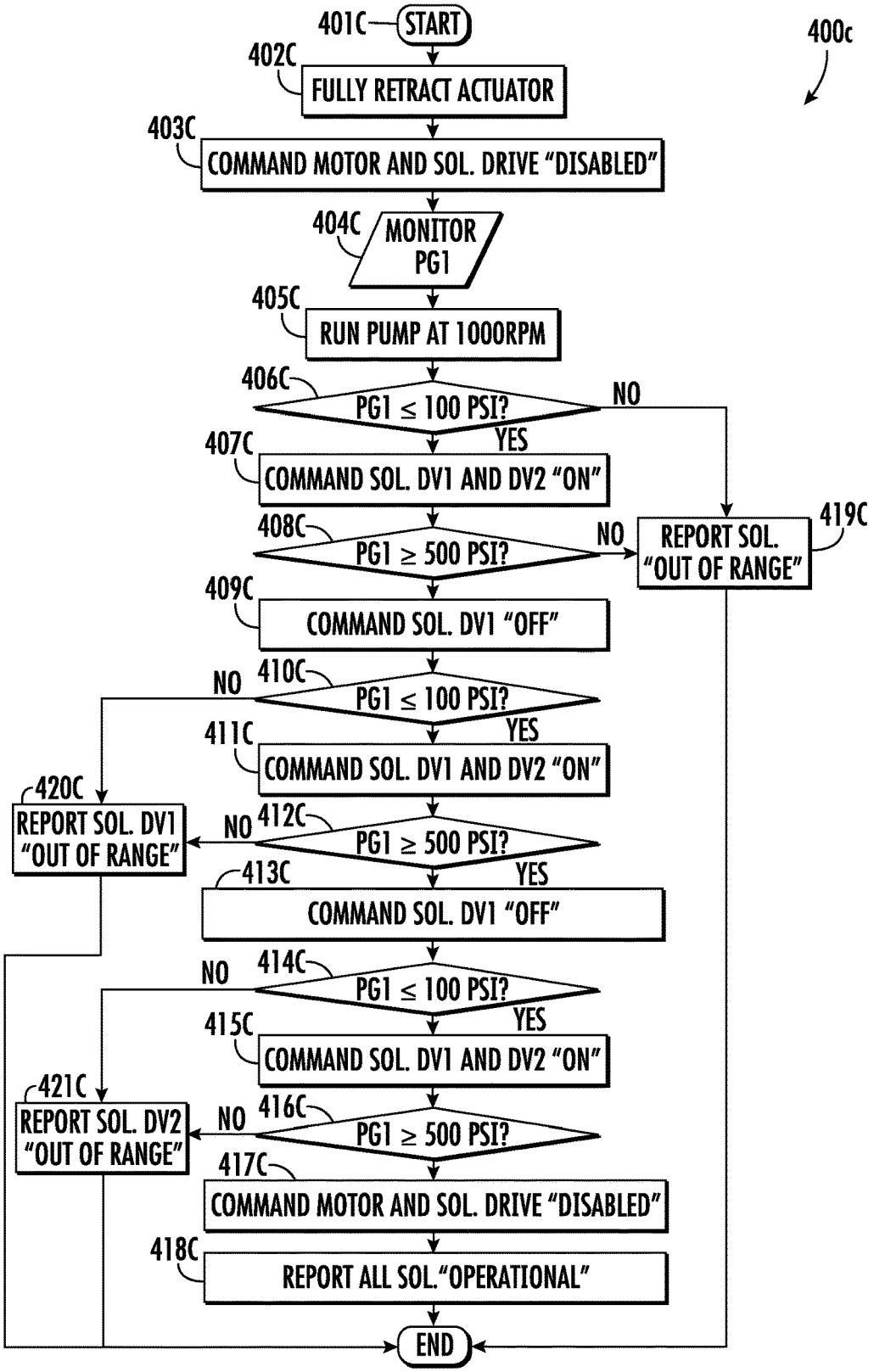
FIG. 25 is a flowchart illustrating a third embodiment of a solenoid diagnostic function of the safety valve actuator system shown in FIG. 5.

FIG. 25 is a flowchart of a third embodiment example method 400*c* of performing diagnostics on solenoid valves 34 and 35 implemented in controller 74 and diagnostic module 75. Method 400*c* may be embodied in computer readable code on the computer readable medium such that when the processor of controller 74 executes the computer readable code, the processor executes method 400*c*. Method 400*c* is thus implemented as code stored on the non-transitory computer readable medium of controller 74 and controller 74 executes such processor executable code. In this embodiment, as shown in FIG. 5, solenoid valve 34 includes pressure sensor 41 for pressure monitoring of hydraulic system 93. With reference to FIG. 25, in step 401*c* of diagnostic function 400*c*, a start signal is generated to activate the various steps of method 400*c* and the subject instructions stored on the non-transitory computer readable medium of controller 74. In step 402*c*, controller 74 commands system 90 to fully retract actuator rod 5 and sleeve collar 60 and, with reference to FIG. 5, thereby move sleeve collar 60 to the left and to the position shown in FIG. 8. In step 403*c*, controller 74 commands motor drive 71 and solenoid drive 72 to "disabled" states by turning off the output power at motor drive 71 so motor 10 can spin freely and by turning off the output power at solenoid drive 72 so solenoids 34 and 35 are not energized and are free to oven, respectively. In step 404*c*, controller 74 monitors pressure sensor 41. In step 405*c*, pump 8 is driven by motor 10 at a predetermined test speed. In this embodiment, such test speed is 1000 rpms, but alternative test speeds may be employed as desired. In block 406*c*, controller 74 determines if pressure sensor 41 indicates that a first threshold pressure has been exceeded. In this embodiment, such first threshold pressure is 100 psi, but alternative pressure thresholds may be employed as desired. If pressure sensor 41 indicates in block 406*c* pressure greater than the first threshold pressure, in step 419*c* controller 74 generates an "error" or "out of range" signal or report indicating a fault in the solenoid valves 34 and 35. On the other hand, if pressure sensor 41 indicates in block 406*c* pressure less than or equal to the first threshold pressure, in step 407*c* controller 74 commands both solenoid valves 34 and to an "on" or energized state via solenoid drive 72. In block 408*c*, controller 74 determines if pressure sensor 41 indicates that a second threshold pressure has been exceeded. In this embodiment, such second threshold pressure is 500 psi, but alternative pressure thresholds may be employed as desired. If pressure sensor 41 indicates in block 407*c* pressure less than the second threshold pressure, in step 419*c* controller 74 generates an "error" or "out of range" signal or report indicating a fault in solenoid valves 34 and 35. On the other hand, if pressure sensor 41 indicates in block 408*c* pressure greater than or equal to the second threshold pressure, in step 409*c* controller 74 commands solenoid valve 34 to an "off" or deenergized state via solenoid drive 72. In block 410*c*, controller 74 determines if pressure sensor 41 indicates that a third threshold pressure has been exceeded. In this embodiment, such third threshold pressure is 100 psi, but alternative pressure thresholds may be employed as desired. If pressure sensor 41 indicates in block 410*c* pressure greater than the third threshold pressure, in step 420*c* controller 74 generates an "error" or "out of range" signal or report indicating a fault in solenoid valve 34. On the other hand, if pressure sensor 41 indicates in block 410*c* pressure less than or equal to the third threshold pressure, in step 411*c* controller 74 commands both solenoid valves 34 and 35 to an "on" or energized state via solenoid drive 72. In block 412*c*, controller 74 determines if pressure sensor 41 indicates that a fourth threshold pressure has been exceeded. In this embodiment, such fourth threshold pressure is 500 psi, but alternative pressure thresholds may be employed as desired. If pressure sensor 41 indicates in block 412*c* pressure less than the fourth threshold pressure, in step 420*c* controller 74 generates an "error" or "out of range" signal or report indicating a fault in solenoid valve 34. On the other hand, if pressure sensor 41 indicates in block 412*c* pressure greater than or equal to the fourth threshold pressure, in step 413*c* controller 74 commands solenoid valve 34 to an "off" or deenergized state via solenoid drive 72. In block 414*c*, controller 74 determines if pressure sensor 41 indicates that a fifth threshold pressure has been exceeded. In this embodiment, such fifth threshold pressure is 100 psi, but alternative pressure thresholds may be employed as desired. If pressure sensor 41 indicates in block 414*c* pressure greater than the fifth threshold pressure, in step 421*c* controller 74 generates an "error" or "out of range" signal or report indicating a fault in solenoid valve 35. On the other hand, if pressure sensor 41 indicates in block 414*c* pressure less than or equal to the fifth threshold pressure, in step 415*c* controller 74 commands both solenoid valves 34 and 35 to an "on" or energized state via solenoid drive 72. In block 416*c*, controller 74 determines if pressure sensor 41 indicates that a sixth threshold pressure has been exceeded. In this embodiment, such sixth threshold pressure is 500 psi, but alternative pressure thresholds may be employed as desired. If pressure sensor 41 indicates in block 416*c* pressure less than the sixth threshold pressure, in step 421*c* controller 74 generates an "error" or "out of range" signal or report indicating a fault in solenoid valve 35. On the other hand, if pressure sensor 41 indicates in block 416*c* pressure greater than or equal to the sixth threshold pressure, in step 417*c* controller 74 commands motor drive 71 and solenoid drive 72 to "disabled" states. In step 418*c* controller 74 generates an operational signal or report and both solenoid valves 34 or 35 are diagnosed as being fully operational. Controller 74 may also provide a valve closure command upon an error or out of range signal to place safety valve 90 in a failsafe closed position. Error or out of range signals may be transmitted to surface controller 11 on platform 100 and if no errors are detected then controller 74 may send a confirming operational signal to surface controller 11 on platform 100. While in this embodiment various pressure thresholds have been disclosed, other pressure thresholds may be employed depending on the desired operating parameters of the system.

Thus, a redundant fault tolerant hydraulic system is provided for closure of safety valve assembly 91 and the critical components of such system may be automatically tested periodically to diagnose or detect faults in such components.

The present invention contemplates that many changes and modifications may be made. Therefore, while an embodiment of the improved subsurface safety valve actuation system has been shown and described, and a number of alternatives discussed, persons skilled in this art will readily appreciate that various additional changes and modifications may be made without departing from the spirit of the invention, as defined and differentiated by the following claims.

What is claimed is:

1. A subsurface safety valve actuation system comprising:

tubing arranged in a well and forming a flow channel to a surface level for fluids originating from below said surface level;

a safety valve in said tubing below said surface level and operable between an open position and a closed position to control a flow of fluids in said flow channel;

a hydraulic piston assembly in said tubing below said surface level comprising a first chamber and a piston between said first chamber and said safety valve;

an electric motor in said tubing below said surface level and configured to be supplied with a current;

a hydraulic pump in said tubing below said surface level and configured to be driven by said motor and connected to said first chamber of said hydraulic piston assembly;

a spring element in said tubing below said surface level and configured to provide a spring force upon said piston;

a fluid reservoir connected to said pump and said first chamber;

a first valve connected to said first chamber and said fluid reservoir and having a first open position and a first closed position;

a second valve connected to said first chamber and said fluid reservoir and having a second open position and a second closed position;

said pump, hydraulic piston assembly, first valve, second valve and reservoir connected in a substantially closed hydraulic system;

wherein said hydraulic system is configured in a first state to provide pressure in said first chamber that drives said safety valve from said closed position to said open position;

wherein said hydraulic system is configured in a second state to retain a pressure level in said first chamber that retains said safety valve in said open position;

wherein said hydraulic system is configured in a third state to release said pressure level in said first chamber via a first hydraulic release path between said first chamber and said reservoir that extends through said first valve when said first valve is in said first open position;

wherein said hydraulic system is configured in a fourth state to release said pressure level in said first chamber via a second hydraulic release path between said first chamber and said reservoir that extends through said second valve when said second valve is in said second open position; and wherein said first hydraulic release path is at least in part independent from said second hydraulic release path and said second hydraulic release path is at least in part independent from said first hydraulic release path;

whereby said pressure level in said first chamber that retains said safety valve in said open position may be released via said first hydraulic release path when there is a fault in said second hydraulic release path and may be released via said second hydraulic release path when there is a fault in said first hydraulic release path.

2. The actuation system set forth in claim 1, wherein said first hydraulic release path extends through said pump.

3. The actuation system set forth in claim 2, wherein said first state comprises providing a hydraulic force on said piston that is opposite to and exceeds said spring force and said piston translating in a first direction and actuating said safety valve to said open position.

4. The actuation system set forth in claim 3, wherein said first state comprises said first valve in said first open position and driving said motor to control a flow of fluid to said first chamber through said pump.

5. The actuation system set forth in claim 4, wherein said second hydraulic release path bypasses and is independent of said pump and said first state comprises said first valve in said first open position and said second valve in said second closed position.

6. The actuation system set forth in claim 5, wherein:

said hydraulic piston assembly comprises a second chamber connected to said fluid reservoir;

said piston separates said first and second chambers;

a positive pressure differential between said first chamber and said second chamber provides said hydraulic force on said piston that is opposite to and exceeds said spring force;

a negative pressure differential between said first chamber and said second chamber provides a hydraulic force on said piston in a second direction opposite to said first direction; and said third state comprises said negative pressure differential and said resulting hydraulic force and said spring force causing said piston to translate in a second direction actuating said safety valve to said closed position.

7. The actuation system set forth in claim 2, wherein said second state comprises providing a hydraulic force on said piston that is opposite and at least equal to said spring force.

8. The actuation system set forth in claim 7, wherein:

said second state comprises said first valve in said first closed position;

said second hydraulic release path bypasses and is independent of said pump; and said second state comprises said second valve in said second closed position.

9. The actuation system set forth in claim 2, wherein said third state comprises providing a hydraulic force on said piston opposite to said spring force that is less than said spring force and said piston translating in a second direction opposite to said first direction and actuating said safety valve to said closed position.

10. The actuation system set forth in claim 9, wherein said second hydraulic release path bypasses and is independent of said pump.

11. The actuation system set forth in claim 10, wherein said third state comprises said second valve in a faulted closed position.

12. The actuation system set forth in claim 11, wherein said third state comprises driving said motor to control a rate of fluid flow in said first hydraulic release path.

13. The actuation system set forth in claim 11, wherein said third state comprises releasing said motor and said pump to allow fluid flow in said first hydraulic release path.

14. The actuation system set forth in claim 10, wherein said third state comprises said second valve in said second closed position and driving said motor to control a rate of fluid flow in said first hydraulic release path.

15. The actuation system set forth in claim 10, wherein said third state comprises said second valve in said second closed position and releasing said motor and said pump to allow fluid flow in said first hydraulic release path.

16. The actuation system set forth in claim 2, wherein said fourth state comprises providing a hydraulic force on said piston opposite to said spring force that is less than said spring force and said piston translating in a second direction opposite to said first direction and actuating said safety valve to said closed position.

17. The actuation system set forth in claim 16, wherein said fourth state comprises said first valve in a faulted closed position and/or said pump in a faulted blocked flow position.

18. The actuation system set forth in claim 1, comprising:

a third hydraulic release path between said first chamber and said reservoir that extends through said pump when said motor and said pump are released to allow fluid flow in said third hydraulic release path; and wherein said third hydraulic release path is at least in part independent from both said first hydraulic release path and said second hydraulic release path and said first hydraulic release path bypasses and is independent of said pump and said second hydraulic release path bypasses and is independent of said pump.

19. The actuation system set forth in claim 18, wherein said system is configured in a fifth state to release said pressure level in said first chamber via said third hydraulic release path between said first chamber and said reservoir that extends through said pump when said motor and said pump are released to allow fluid flow in said third hydraulic release path.

20. The actuation system set forth in claim 1, wherein said fluid reservoir comprises a pressure compensator configured to normalize pressure differences between outside said hydraulic system and inside said hydraulic system.

21. The actuation system set forth in claim 20, wherein said pressure compensator comprises a membrane or a piston and comprising a position sensor configured to sense position of said membrane or said piston.

22. The actuation system set forth in claim 1, wherein said first valve comprises a solenoid valve arranged to open in the event of a power failure allowing equalization of fluid pressure on each side of said first valve and said second valve comprises a solenoid valve arranged to open in the event of a power failure allowing equalization of fluid pressure on each side of said second valve.

23. The actuation system set forth in claim 1, wherein:

said tubing comprises an outer tubular surface orientated about a longitudinal axis and an inner tubular surface orientated about said longitudinal axis and defining said flow channel;

said tubing comprises a first module cavity between said inner tubular surface and said outer tubular surface;

said tubing comprises a second module cavity between said inner tubular surface and said outer tubular surface;

said hydraulic piston assembly is disposed in said first module cavity; and said motor and said pump are disposed in said second module cavity.

24. The actuation system set forth in claim 23, wherein said safety valve comprises:

a flapper element configured to rotate about a hinge axis between said open position and said closed position in said flow channel;

said hinge axis fixed relative to said tubing; and a flapper actuation sleeve orientated about said longitudinal axis and configured to move said flapper element from said closed position to said open position in said flow channel.

25. The actuation system set forth in claim 24, wherein said hydraulic piston assembly comprises a first actuator rod connected to said piston for movement therewith, a first actuator collar connected to said actuator rod for movement therewith, and said flapper actuation sleeve is connected to said actuator collar for movement therewith.

26. The actuation system set forth in claim 25, wherein said spring element is in compression between said piston and said tubing in said second state and comprises a coil spring orientated about said longitudinal axis and disposed axially between said hinge axis and said first actuator collar.

27. The actuation system set forth in claim 1, wherein:

said hydraulic piston assembly comprises a second chamber connected to said fluid reservoir and said piston separates said first and second chambers;

said piston comprises a first surface area exposed to said first chamber and a second surface area exposed to said second chamber; and said first surface area is equal to or greater than said second surface area.

28. The actuation system set forth in claim 1, comprising:

subsurface control electronics below said surface level and connected to said motor, said first valve and said second valve;

a surface controller above said surface level;

a power cable supplying electric power from said surface level to said subsurface control electronics;

a communication cable between said subsurface control electronics and said surface controller;

multiple sensors configured to sense operating parameters of said system; and said subsurface control electronics comprising a signal processor communicating with said sensors and configured to receive sensor data from said sensors and to output data to said surface controller via said communication cable.

29. The actuation system set forth in claim 1, wherein said electric motor comprises a variable speed bidirectional electric motor and said pump comprises a reversible hydraulic pump.

30. The actuation system set forth in claim 1, comprising:

a subsurface controller below said surface level and connected to said motor, said first valve and said second valve;

a subsurface sensor below said surface level configured to sense an operating parameter of a component of said actuation system and connected to said controller; and said subsurface controller comprising a non-transitory, computer-readable medium storing one or more instructions executable by said subsurface controller to perform a diagnostic test of said component of said actuation system as a function of said operating parameter of said component of said actuation system sensed by said subsurface sensor.

* * * * *